US010491990B2

(12) United States Patent
Shigihara et al.

(10) Patent No.: US 10,491,990 B2
(45) Date of Patent: Nov. 26, 2019

(54) THROAT AND SPEAKER SYSTEM

(71) Applicant: JVC KENWOOD Corporation, Yokohama-shi, Kanagawa (JP)

(72) Inventors: Akihide Shigihara, Yokohama (JP); Masatake Onishi, Yokohama (JP)

(73) Assignee: JVCKENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/296,134

(22) Filed: Mar. 7, 2019

(65) Prior Publication Data

US 2019/0281383 A1 Sep. 12, 2019

(30) Foreign Application Priority Data

Mar. 8, 2018 (JP) ..... 2018-041472

(51) Int. Cl.

| | |
|---|---|
| ***H04R 25/00*** | (2006.01) |
| ***H04R 1/30*** | (2006.01) |
| ***G10K 11/26*** | (2006.01) |
| ***G10K 11/08*** | (2006.01) |
| ***H04R 1/32*** | (2006.01) |

(52) U.S. Cl.

CPC ..... *H04R 1/30* (2013.01); *G10K 11/08* (2013.01); *G10K 11/26* (2013.01); *H04R 1/323* (2013.01)

(58) Field of Classification Search

CPC ..... H04R 1/30; H04R 1/323; G10K 11/26
USPC ..... 381/340
See application file for complete search history.

(56) References Cited

U.S. PATENT DOCUMENTS

| | | | | |
|---|---|---|---|---|
| 6,343,133 | B1 * | 1/2002 | Adamson | H04R 1/26 181/152 |
| 7,936,892 | B2 * | 5/2011 | Werner | H04R 1/345 181/177 |
| 9,215,524 | B2 * | 12/2015 | McKinnon | G10K 11/26 |
| 2007/0080019 | A1 | 4/2007 | Kubota | |
| 2008/0264717 | A1 | 10/2008 | Onishi | |

FOREIGN PATENT DOCUMENTS

| | | |
|---|---|---|
| JP | 2008-278145 A | 11/2008 |
| WO | 2004/086812 A1 | 10/2004 |

* cited by examiner

*Primary Examiner* — Phylesha Dabney
(74) *Attorney, Agent, or Firm* — Procopio, Cory, Hargreaves & Savitch LLP

(57) ABSTRACT

Provided is a throat and a speaker system that can properly correct a path length of a sound wave. A throat according to an embodiment includes a first side wall, a second side wall, a third side wall, and a fourth side wall. A third opposing surface of the third side wall and a fourth opposing surface of the fourth side wall are each formed into a curved surface having a convex portion and a concave portion. The convex portion and the concave portion are so disposed as to oppose each other, and the convex portion and the concave portion are so disposed as to oppose each other. Amplitudes of the curved third opposing surface and the curved fourth opposing surface gradually decrease along a direction from a reference center line to a first opposing surface or a second opposing surface.

7 Claims, 27 Drawing Sheets

THROAT AND SPEAKER SYSTEM

CROSS REFERENCE TO RELATED APPLICATION

This application is based upon and claims the benefit of priority from Japanese patent application No. 2018-41472, filed on Mar. 8, 2018, the disclosure of which is incorporated herein in its entirety by reference.

BACKGROUND

The present disclosure relates to throats and speaker systems.

There is a horn speaker in which a horn is provided at an output side of a sound source (driver) in order to efficiently amplify a sound wave from a speaker. In such a horn speaker, a throat is used to convert a driver that is a point sound source to a line sound source.

Japanese Unexamined Patent Application Publication No. 2008-278145 discloses a speaker system that includes a sound source and a horn. The horn includes a throat unit for correcting a sound wave path length and a horn unit for amplification. The throat unit includes a left side surface formed into a concave curved surface and a right side surface formed into a convex curved surface (FIG. 4). This configuration makes it possible to correct a sound wave path extending from an input opening to an output opening.

International Patent Publication No. WO2004/086812 discloses a sound wave guiding structure for a speaker that forms a sound wave guiding route. In this structure, rhombic obstacles are formed in a sound path to allow the sound path extending from an input opening to an output opening to branch at a plurality of stages.

SUMMARY

According to Japanese Unexamined Patent Application Publication No. 2008-278145, the slope of the direction in which the sound wave travels relative to the output opening is large. This causes the output sound wave to have a directivity.

According to International Patent Publication No. WO2004/086812, the sound path is made to branch multiple times at the obstacles to produce points with an equal reaching distance, and a line sound source is thus achieved. This structure, however, suffers from shortcomings in that a high-pitched sound is likely to be attenuated in a throat.

A throat according to the embodiments is a throat configured to correct a path length of a sound wave output by a sound source, the throat comprising: a first side wall; a second side wall; a third side wall; and a fourth side wall, the first to fourth side walls defining a sound path extending from an input opening to an output opening, wherein the first side wall and the second side wall oppose each other with the sound path interposed therebetween, the third side wall and the fourth side wall oppose each other with the sound path interposed therebetween, the output opening has a lengthwise direction extending in a direction from the first side wall toward the second side wall and a widthwise direction extending in a direction from the third side wall toward the fourth side wall, the first side wall has a first opposing surface opposing the second side wall, and the second side wall has a second opposing surface opposing the first opposing surface, the first opposing surface and the second opposing surface constituting a pair of tapered surfaces with a gap therebetween increasing along a direction from the input opening toward the output opening, the third side wall has a third opposing surface opposing the fourth side wall, the third opposing surface being formed into a curved surface having a convex portion and a concave portion, and the third opposing surface having a periodic structure in which the convex portion and the concave portion are disposed in a repeated manner in the direction from the input opening toward the output opening, the fourth side wall has a fourth opposing surface opposing the third side wall, the fourth opposing surface being formed into a curved surface having a convex portion and a concave portion, the fourth opposing surface having a periodic structure in which the convex portion and the concave portion are disposed in a repeated manner in the direction from the input opening toward the output opening, the convex portion of the third opposing surface and the concave portion of the fourth opposing surface are so disposed as to oppose each other, and the concave portion of the third opposing surface and the convex portion of the fourth opposing surface are so disposed as to oppose each other, and with a straight line connecting a center of the input opening and a center of the output opening serving as a reference center line, an amplitude of the curved third opposing surface and an amplitude of the curved fourth opposing surface gradually decrease along a direction from the reference center line to the first opposing surface or the second opposing surface.

The embodiments are directed to provide a throat and a speaker system that can properly correct a sound path length and efficiently amplify a sound wave from a speaker.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

First Embodiment

Figure 1:
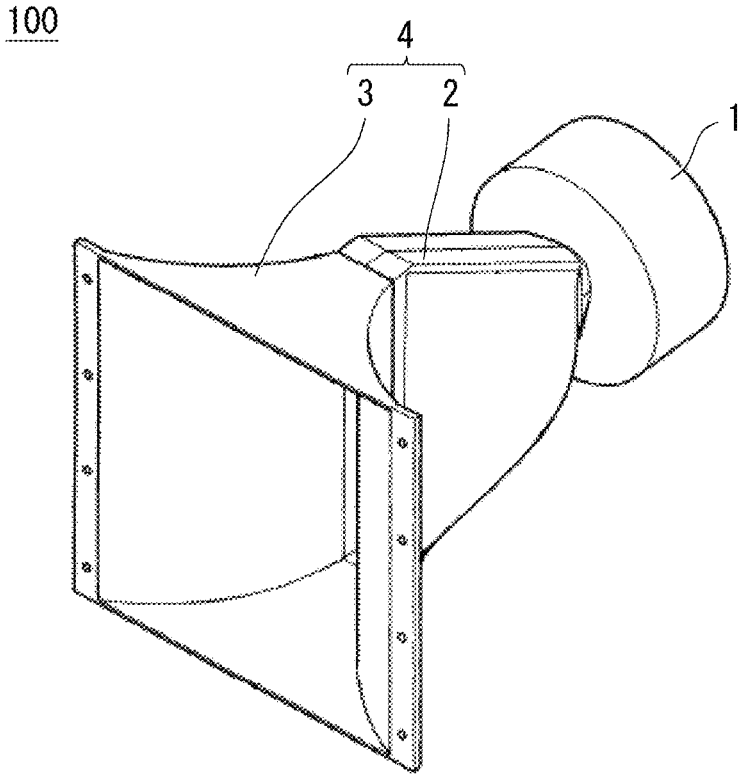
FIG. 1 is a perspective view illustrating a speaker system in which a throat is used.

A throat and a speaker system according to the present embodiment will be described with reference to the drawings. FIG. 1 is a perspective view schematically illustrating an overall configuration of a speaker system in which a throat is used.

As illustrated in FIG. 1, a speaker system 100 includes a sound source 1, a throat 2, and a horn 3. A principal feature of the present embodiment lies in the structure of the throat 2 disposed between the sound source 1 and the horn 3. The sound source 1 is a driver having a speaker and outputs a sound wave. The sound source 1 is, for example, a point sound source.

The sound source 1 is disposed at an input side of the throat 2. The throat 2 corrects a path length of a sound wave output from the sound source 1. Thus, the sound source 1, which is a point sound source, can be converted to a line sound source. The horn 3 is disposed at an output side of the throat 2. The horn 3 amplifies a sound wave from the throat 2 toward an outer space. The throat 2 and the horn 3 constitute a horn throat 4. The throat 2 and the horn 3 may be an integrated member or may be separate components.

Figure 2:
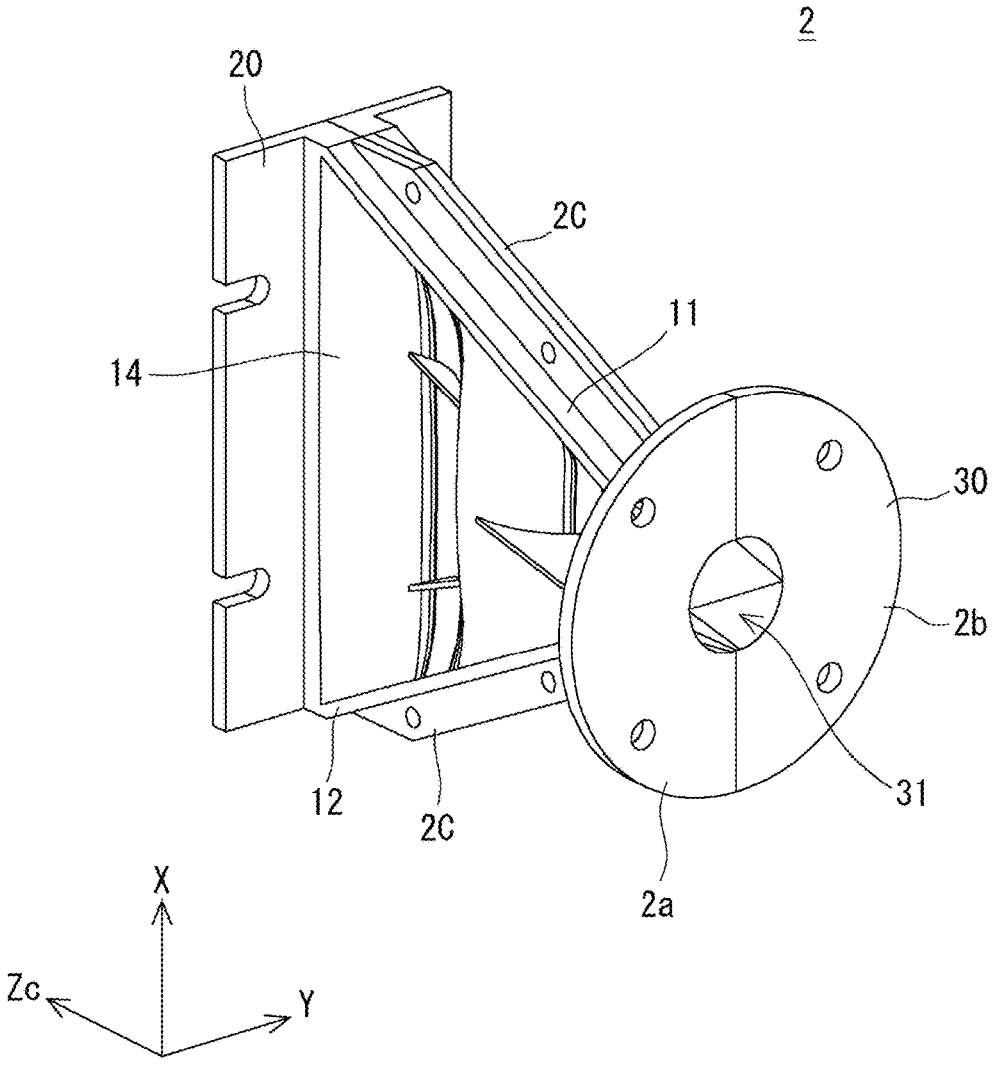
FIG. 2 is a perspective view illustrating a configuration of a throat as viewed from the side where a sound source is provided.

The throat has a structure that corrects the path length of a sound wave output by the sound source. The configuration of the throat 2, which is a principal feature of the embodiment, will be described with reference to FIGS. 2 and 3. FIG. 2 is a perspective view of the throat as viewed from the side where the sound source is provided, and FIG. 3 is a perspective view of the throat as viewed from the side where the horn is provided.

Figure 3:
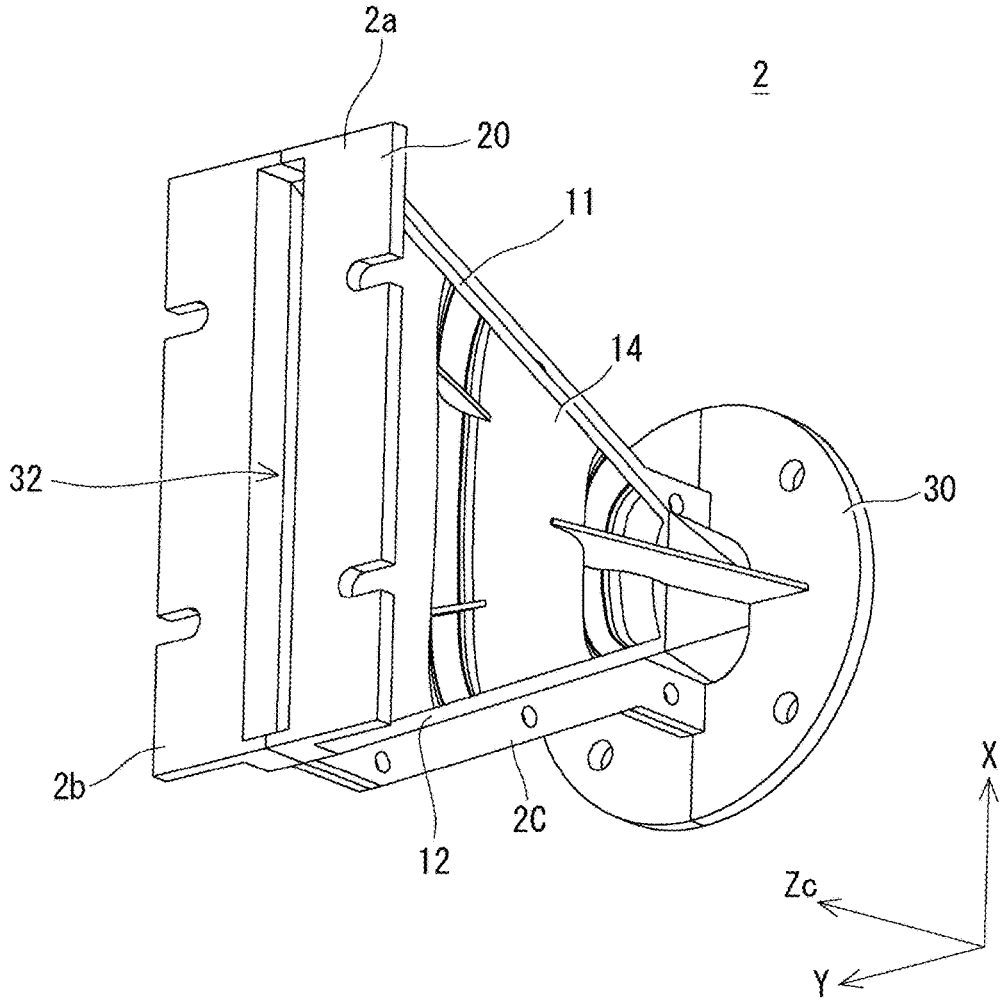
FIG. 3 is a perspective view illustrating a configuration of a throat as viewed from an output side.

As illustrated in FIGS. 2 and 3, the throat 2 includes a first component 2*a* and a second component 2*b*. The throat 2 is configured as the first component 2*a* and the second component 2*b* are integrated into a unit. The first component 2*a* and the second component 2*b* are coupled by flanges 2C. For example, an opening is formed in each flange 2C to allow a bolt or the like for fastening to pass therethrough. The first component 2*a* and the second component 2*b* are each, for example, a resin molded product.

The throat 2 includes an output end surface 20 and an input end surface 30. The output end surface 20 serves as a flange to be connected to the horn 3. An output opening 32 is formed in the output end surface 20 of the throat 2. The output opening 32 is slit-shaped, that is, has a rectangular shape having a lengthwise direction and a widthwise direction. The output opening 32 has a widthwise opening size of approximately 12 mm and a lengthwise opening size of approximately 118 mm.

The input end surface 30 serves as a flange to be connected to the sound source 1. An input opening 31 is formed in the input end surface 30 of the throat 2. The input opening 31 is circular in shape. The input opening 31 has a diameter of, for example, 24 mm. The space between the input opening 31 and the output opening 32 serves as a sound path.

Hereinafter, to facilitate the understanding of the description, a three-dimensional orthogonal coordinate system such as those illustrated in FIGS. 2 and 3 will be used. The Zc-direction extends from a center point in the input opening 31 to a center point in the output opening 32. In a plane perpendicular to the Zc-direction, the X-direction is parallel to the lengthwise direction of the output opening 32, and the Y-direction is parallel to the widthwise direction of the output opening 32. The XY-plane is parallel to the input end surface 30, that is, parallel to the rectangular output opening 32. A straight line passing through the center of the output opening 32 and parallel to the Zc-direction is referred to as a reference center line as well. The reference center line is perpendicular to the output end surface 20 having the output opening 32 and the input end surface 30 having the input opening 31.

Figure 4:
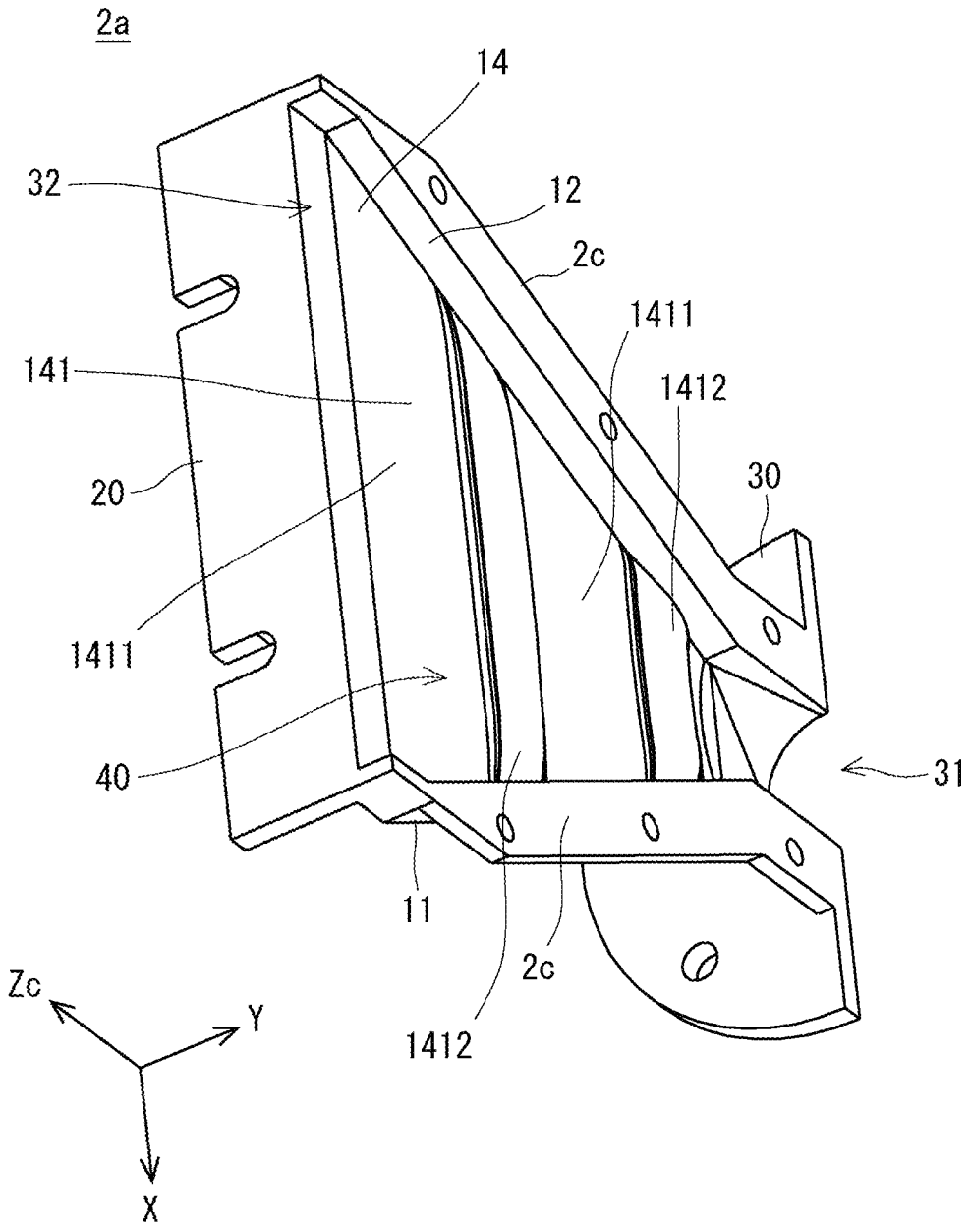
FIG. 4 is a perspective view illustrating an inner side of a first component of a throat.
Figure 5:
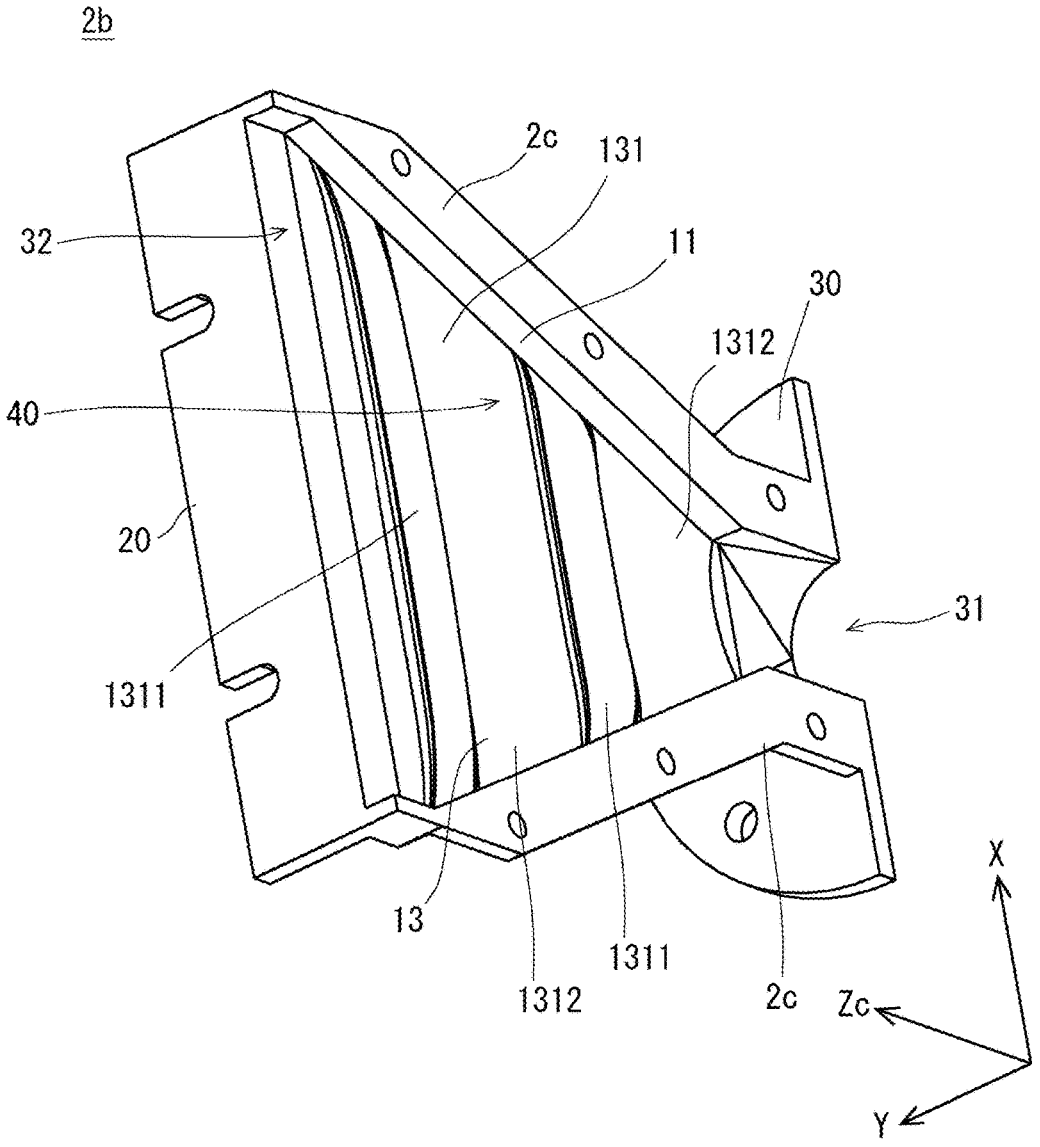
FIG. 5 is a perspective view illustrating an inner side of a second component of a throat.

FIG. 4 is a perspective view illustrating an inner structure of the first component 2*a*, and FIG. 5 is a perspective view illustrating an inner structure of the second component 2*b*. As illustrated in FIGS. 2 to 5, the throat 2 includes a first side wall 11, a second side wall 12, a third side wall 13, and a fourth side wall 14. The space enclosed by the first side wall 11, the second side wall 12, the third side wall 13, and the fourth side wall 14 serves as a sound path 40. Thus, the first side wall 11, the second side wall 12, the third side wall 13, and the fourth side wall 14 shield the sound path 40 from the outer space. The direction extending from the first side wall 11 toward the second side wall 12 coincides with the lengthwise direction of the output opening 32 (X-direction), and the direction extending from the third side wall 13 toward the fourth side wall 14 coincides with the widthwise direction of the output opening 32 (Y-direction).

The +X-side end of the sound path 40 is defined by the first side wall 11, and the −X-side end of the sound path 40 is defined by the second side wall 12. The first side wall 11 is disposed at an end portion of the sound path 40 in the +X-direction, and the second side wall 12 is disposed at an end portion of the sound path 40 in the −X-direction. The first side wall 11 and the second side wall 12 oppose each other with the sound path 40 interposed therebetween. The first side wall 11 and the second side wall 12 constitute a pair of tapered walls. In other words, the gap between the first side wall 11 and the second side wall 12 in the X-direction gradually increases along the Zc-direction from the input opening 31 toward the output opening 32. In the X-direction, The input opening 31 is wider than the output opening 32. Therefore, a sound wave input through the input opening 31 propagates in the sound path 40 while diverging in the X-direction. Thus, a point sound source is converted to a line sound source.

The +Y-side end of the sound path 40 is defined by the third side wall 13, and the −Y-side end of the sound path 40 is defined by the fourth side wall 14. The third side wall 13 is disposed at an end portion of the sound path 40 in the +Y-direction, and the fourth side wall 14 is disposed at an end portion of the sound path 40 in the −Y-direction. The third side wall 13 and the fourth side wall 14 oppose each other with the sound path 40 interposed therebetween. The third side wall 13 and the fourth side wall 14 constitute a pair of opposing walls. The first side wall, the second side wall, the third side wall, and the fourth side wall define the sound path 40 extending from the input opening 31 to the output opening 32.

The throat 2 is configured as the first component 2*a* and the second component 2*b* are connected to each other at their connecting surfaces lying in the XZc-plane. A half of the first side wall 11 and a half of the second side wall 12 are constituted by the second component 2*b*, and the remaining half of the first side wall 11 and the remaining half of the second side wall 12 are constituted by the first component 2*a*. The third side wall 13 is constituted by the second component 2*b*. The fourth side wall 14 is constituted by the first component 2*a*. The first component 2*a* includes a half of the first side wall 11, a half of the second side wall 12, and the fourth side wall 14. The second component 2*b* includes another half of the first side wall 11, another half of the second side wall 12, and the third side wall 13.

Figure 7:
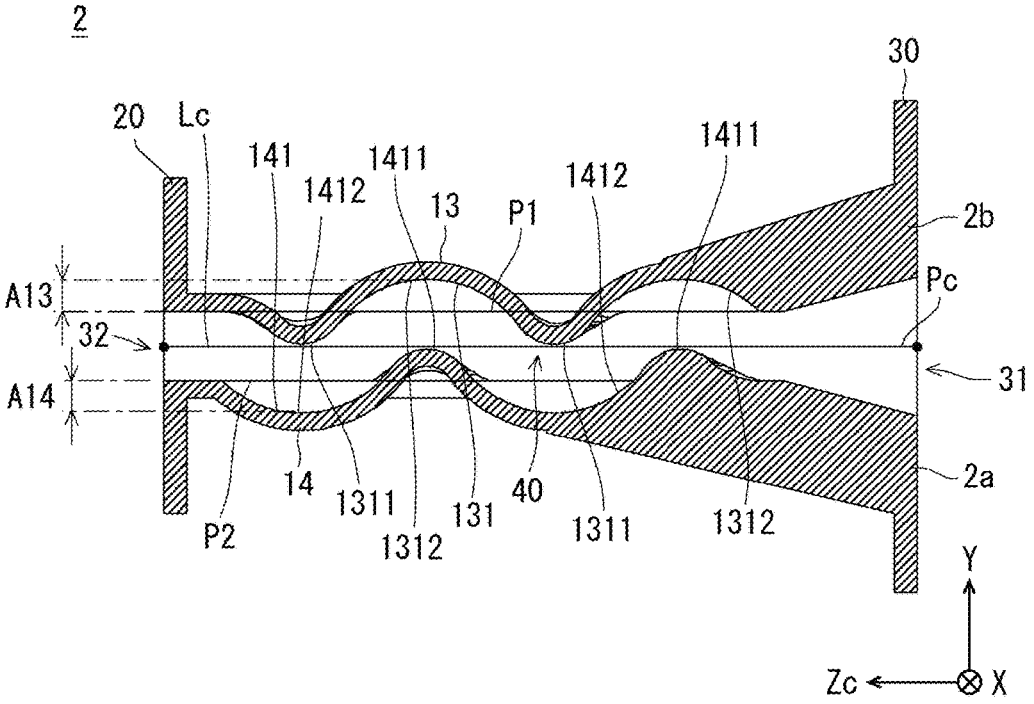
FIG. 7 is a sectional view taken along the VII-VII plane indicated in FIG. 6.

The third side wall 13 and the fourth side wall 14 oppose each other with the sound path 40 interposed therebetween (see also FIG. 7). The third side wall 13 includes a third opposing surface 131 that opposes the fourth side wall 14. In a similar manner, the fourth side wall 14 includes a fourth opposing surface 141 that opposes the third side wall 13. The third opposing surface 131 and the fourth opposing surface 141 are in contact with the sound path 40.

The third opposing surface 131 and the fourth opposing surface 141 each have a corrugated shape for correcting the sound path length. As illustrated in FIG. 5, the third side wall 13 includes a convex portion 1311 and a concave portion 1312. As illustrated in FIG. 4, the fourth side wall 14 includes a convex portion 1411 and a concave portion 1412.

Figure 6:
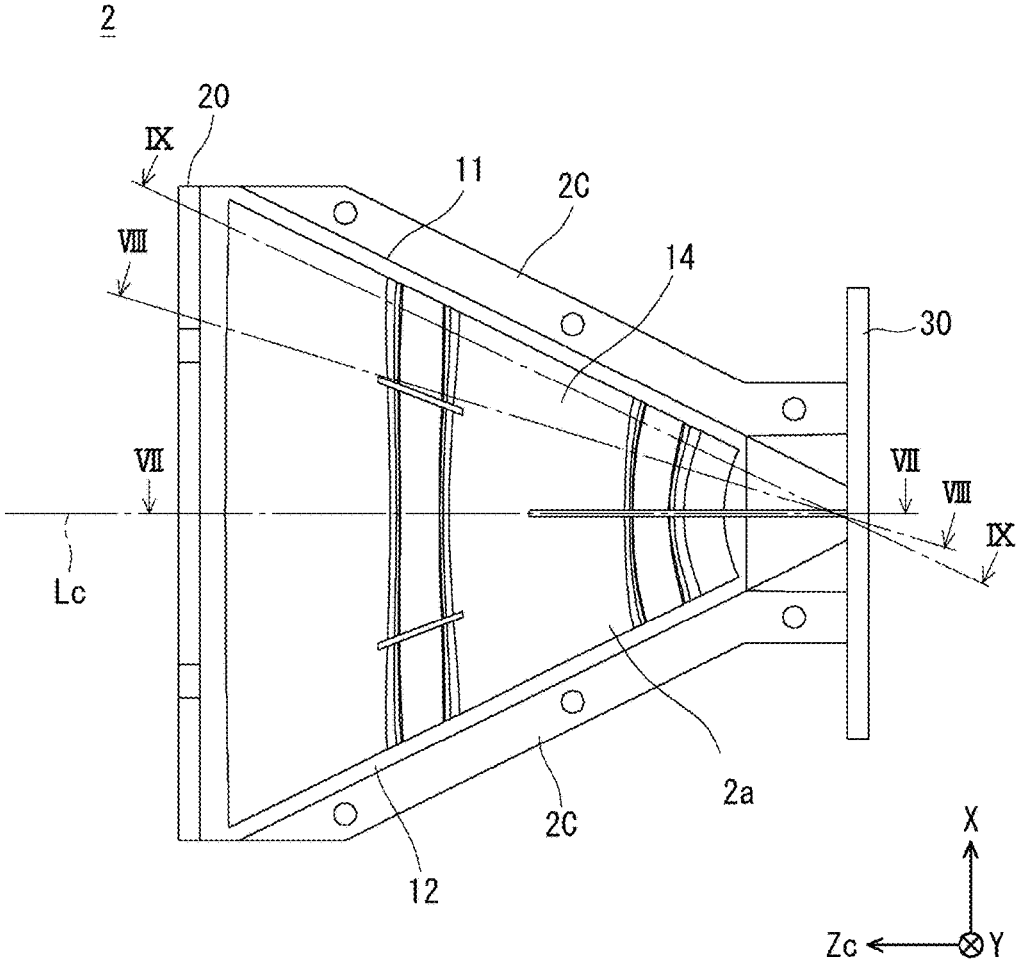
FIG. 6 is a plan view of a throat as viewed from the side where a fourth side wall 14 is provided.
Figure 8:
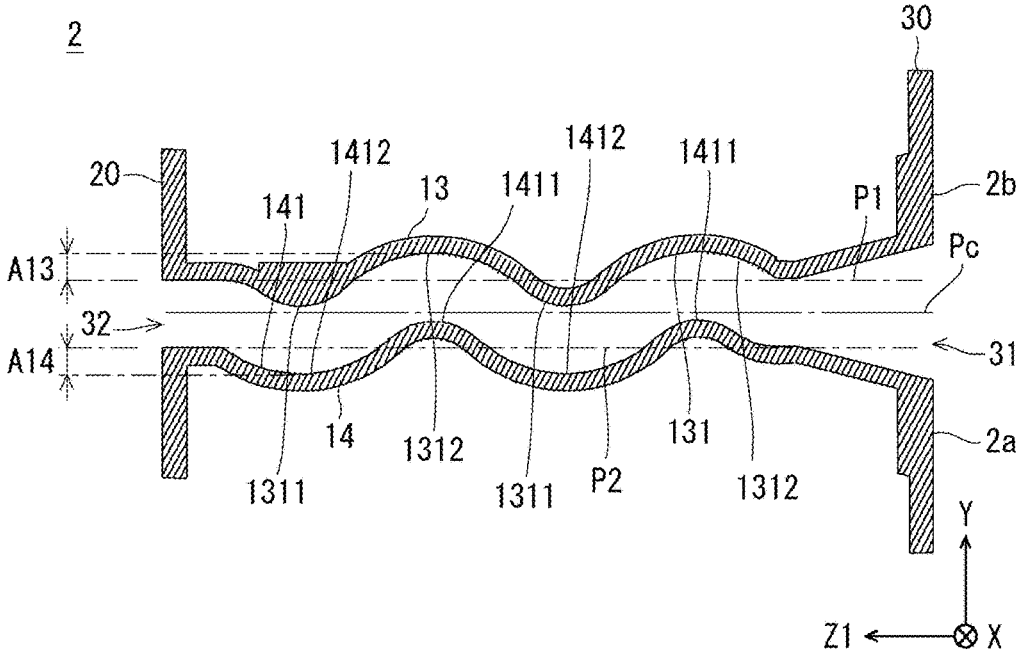
FIG. 8 is a sectional view taken along the VIII-VIII plane indicated in FIG. 6.
Figure 9:
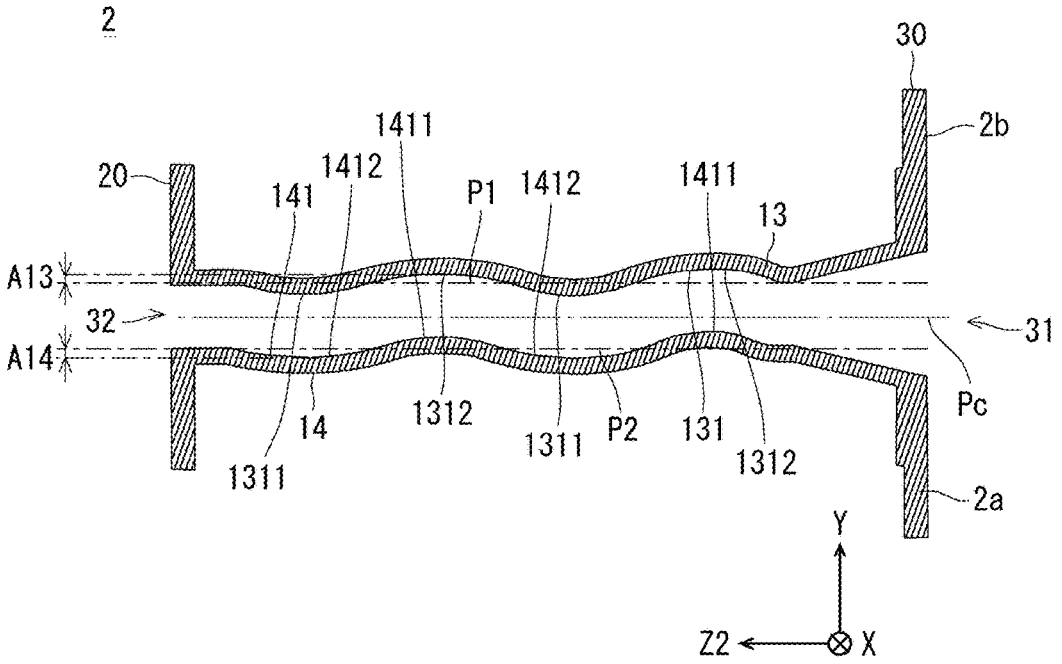
FIG. 9 is a sectional view taken along the IX-IX plane indicated in FIG. 6.

The corrugated shape of each of the third side wall 13 and the fourth side wall 14 will be described with reference to FIGS. 6 to 9. FIG. 6 illustrates the configuration of the throat 2 along the XZc-plane. FIGS. 7 to 9 are sectional views taken along, respectively, the VII-VII plane, the VIII-VIII plane, and the IX-IX plane indicated in FIG. 6.

FIG. 7 is a sectional view of the third side wall 13 and the fourth side wall 14, taken along a plane including their centers in the X-direction. In other words, FIG. 7 is a sectional view along a YZc-plane including a reference center line Lc connecting the center of the input opening 31 and the center of the output opening 32. FIG. 9 is a sectional view of the throat 2 in the vicinity of the first side wall 11. FIG. 8 is a sectional view taken along a plane between the planes of FIGS. 7 and 9. In FIGS. 8 and 9, the cutting planes are inclined relative to the Zc-direction, and thus their cutting planes are denoted as a YZ1-plane and a YZ2-plane, respectively.

As illustrated in FIG. 7, a plane that passes through the center of the input opening 31 and the center of the output opening 32 and that is parallel to the X-direction is referred to as a center plane Pc. The center plane Pc includes the reference center line Lc and is parallel to the X-direction. A plane that passes through the end of the output opening 32 located toward the third side wall 13 and that is parallel to the center plane Pc is referred to as an imaginary plane P1. In a similar manner, a plane that passes through the end of the output opening 32 located toward the fourth side wall 14 and that is parallel to the center plane Pc is referred to as an imaginary plane P2. The imaginary plane P1 includes one of the long sides of the rectangular output opening 32 and is orthogonal to the short sides of the output opening 32. The imaginary plane P2 includes the other one of the long sides of the rectangular output opening 32 and is orthogonal to the short sides of the output opening 32.

The third opposing surface 131 and the fourth opposing surface 141 are each a curved surface having a concave portion and a convex portion. Specifically, the third opposing surface 131 includes the convex portion 1311 that projects further toward the fourth side wall 14 than the imaginary plane P1 and the concave portion 1312 that is recessed further away from the fourth side wall 14 than the imaginary plane P1. The convex portion 1311 and the concave portion 1312 are arranged side by side in the direction from the input opening 31 toward the output opening 32. In a similar manner, the fourth opposing surface 141 includes the convex portion 1411 that projects further toward the third side wall 13 than the imaginary plane P2 and the concave portion 1412 that is recessed further away from the third side wall 13 than the imaginary plane P2. The convex portion 1411 and the concave portion 1412 are arranged side by side in the direction from the input opening 31 toward the output opening 32.

In the third opposing surface 131, the concave portion 1312 and the convex portion 1311 are disposed in an alternating manner in the direction from the input opening 31 toward the output opening 32. The third opposing surface 131 includes two concave portions 1312 and two convex portions 1311.

In the fourth opposing surface 141, the convex portion 1411 and the concave portion 1412 are disposed in an alternating manner in the direction from the input opening 31 toward the output opening 32. The fourth opposing surface 141 includes two convex portions 1411 and two concave portions 1412.

The concave portion 1312 and the convex portion 1411 oppose each other. The convex portion 1311 and the concave portion 1412 oppose each other. The vertical distance between the third opposing surface 131 and the fourth opposing surface 141, that is, the gap between the third opposing surface 131 and the fourth opposing surface 141 is preferably constant. Herein, the gap between the third opposing surface 131 and the fourth opposing surface 141 is constant except at the vicinity of the input opening 31 (i.e., at tapered portions 131*a* and 141*a* described later). In other words, the gap between the third opposing surface 131 and the fourth opposing surface 141 is constant within a predetermined range in the direction from the input opening 31 toward the output opening 32.

As illustrated in the sectional views in FIGS. 7 to 9, the third opposing surface 131 and the fourth opposing surface 141 are each formed to have a wave-like shape along the direction from the input opening 31 toward the output opening 32. The third opposing surface 131 and the fourth opposing surface 141 each have a periodic structure in which a concave portion and a convex portion are disposed in a repeated manner along the direction from the input opening 31 to the output opening 32. The periodic structure in which a concave portion and a convex portion are repeated is formed for one or more periods. The third side wall 13 and the fourth side wall 14 may each have a periodic structure of a sine curve or the like. Alternatively, the third side wall 13 and the fourth side wall 14 may each have a periodic structure in which a hyperbolic curve, an arc curve, a parabolic curve, an elliptic curve, a Cornu's spiral, a cycloid curve, a secondary or higher-order polygonal curve, a common logarithmic curve, a natural logarithmic curve, a catenary curve, or the like is applied.

As illustrated in FIGS. 7 to 9, the distance from the imaginary plane P1 to the bottom of the concave portion 1312 in the Y-direction is regarded as an amplitude A13 of the third opposing surface 131. The amplitude A13 coincides with the distance from the imaginary plane P1 to the peak of the convex portion 1311. The amplitude A13 is defined in accordance with the height and depth of the convex portion 1311 and the concave portion 1312. Specifically, the amplitude A13 is defined by one half the distance from the bottom of the concave portion 1312 to the peak of the convex portion 1311 in the Y-direction.

In a similar manner, the distance from the imaginary plane P2 to the bottom of the concave portion 1412 in the Y-direction is regarded as an amplitude A14. The amplitude A14 coincides with the distance from the imaginary plane P2 to the peak of the convex portion 1411. The amplitude A14 is defined in accordance with the height and depth of the convex portion 1411 and the concave portion 1412. Specifically, the amplitude A14 is defined by one half the distance from the bottom of the concave portion 1412 to the peak of the convex portion 1411 in the Y-direction. In the sectional views, the amplitude A13 and the amplitude A14 are equal to each other. The shapes of the convex portion 1311, the convex portion 1411, the concave portion 1312, and the concave portion 1412 will be described later in detail.

The amplitudes A13 and A14 each represent, for example, the height and depth of the periodic structure as viewed along a section in a plane perpendicular to the center plane Pc and including a straight line passing through the center of the input opening 31. The amplitude A13 and the amplitude A14 vary depending on the position in the X-direction. Specifically, the amplitudes A13 and A14 gradually decrease along the direction from the center in the X-direction toward the first side wall 11 or the second side wall 12. To rephrase, the amplitudes A13 and A14 gradually increase along the direction from the first side wall 11 toward the reference center line Lc in the X-direction and are maximum at the position of the reference center line Lc. The amplitudes A13 and A14 gradually decrease along the direction from the reference center line Lc toward the second side wall 12 in the X-direction. Therefore, in the sectional views illustrated in FIGS. 7 to 9, the amplitudes A13 and A14 are maximum in FIG. 7 and minimum in FIG. 9. The amplitudes A13 and A14 are 0 at respective ends that are in contact with the first side wall 11 and the second side wall 12 (see FIG. 18 described later).

The straight-line distance from the input opening 31 to the output opening 32 is short on the reference center line Lc connecting the center of the input opening 31 and the center of the output opening 32. In contrast, the straight-line distance from the input opening 31 to the output opening 32 is longer in the vicinity of the first side wall 11 and in the vicinity of the second side wall 12. Since the amplitudes A13 and A14 are large in the vicinity of the reference center line Lc, the winding of the sound path 40 is large, which allows for such correction as to increase the path length of the sound wave. In contrast, the straight-line distance is large in the vicinity of the first side wall 11 and in the vicinity of the second side wall 12, which renders it unnecessary to make such correction as to increase the path length. Therefore, the winding of the sound path 40 is reduced, and the sound path 40 is close to being flat.

In this manner, the sound path length can be corrected by gradually reducing the amplitudes A13 and A14 of the concavities and convexities of the sectional shapes along the direction from the reference center line Lc toward the first side wall 11 or the second side wall 12. Thus, the wavefront of the sound wave can be made linear at the output opening 32. A line sound source can be formed at the output opening 32, and the line array characteristics can be achieved. Since the third opposing surface 131 and the fourth opposing surface 141 are smooth curved surfaces, attenuation of a high-pitched sound, that is, a decrease in the sound quality can be suppressed.

Figure 10:
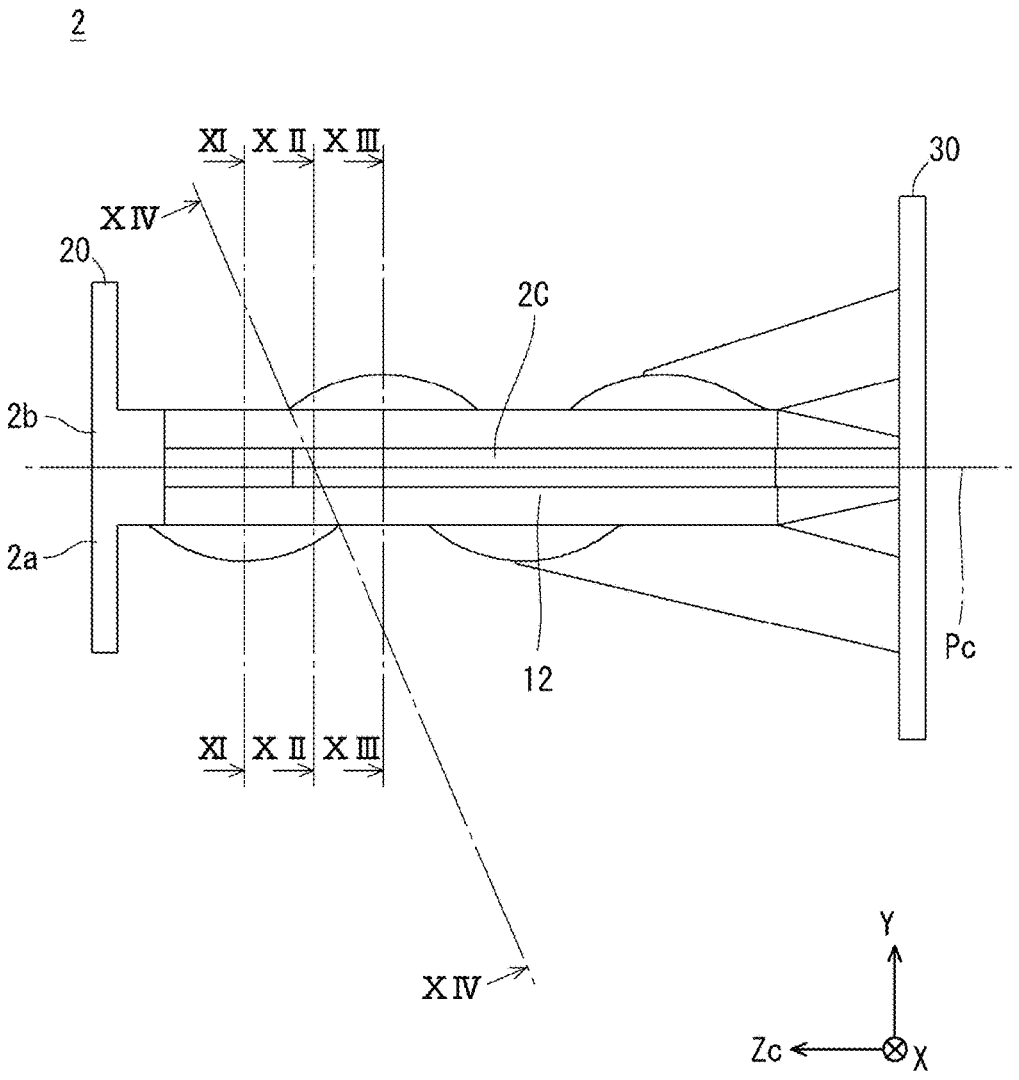
FIG. 10 is a side view of a throat as viewed from the side where a second side wall 12 is provided.
Figure 11:
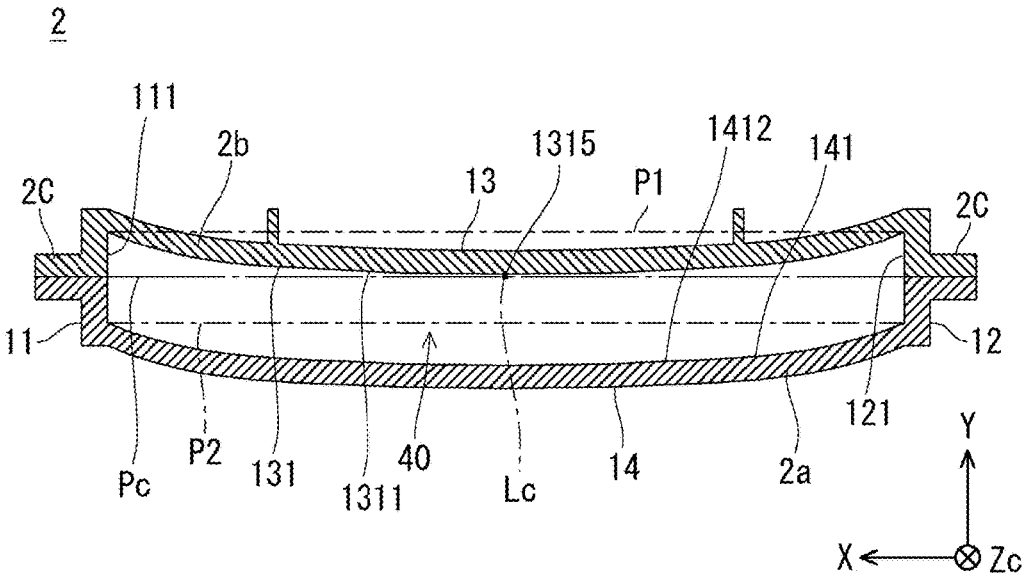
FIG. 11 is a sectional view taken along the XI-XI plane indicated in FIG. 10.
Figure 12:
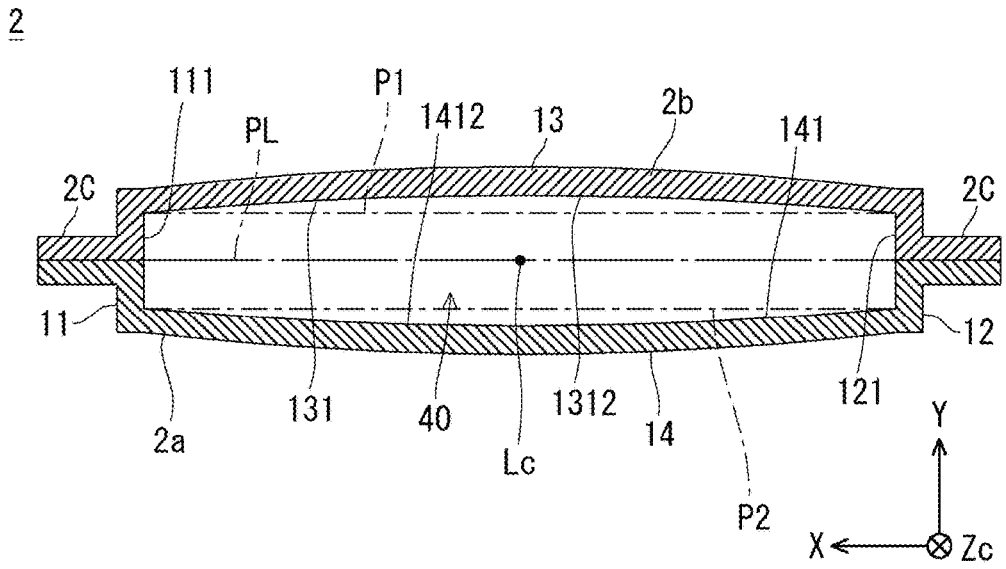
FIG. 12 is a sectional view taken along the XII-XII plane indicated in FIG. 10.
Figure 13:
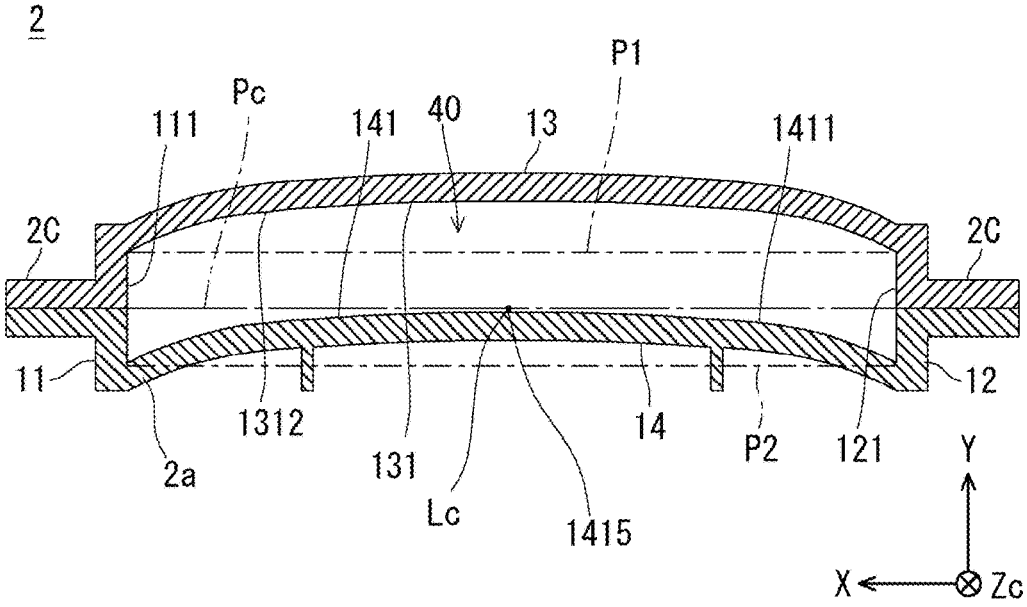
FIG. 13 is a sectional view taken along the XIII-XIII plane indicated in FIG. 10.
Figure 14:
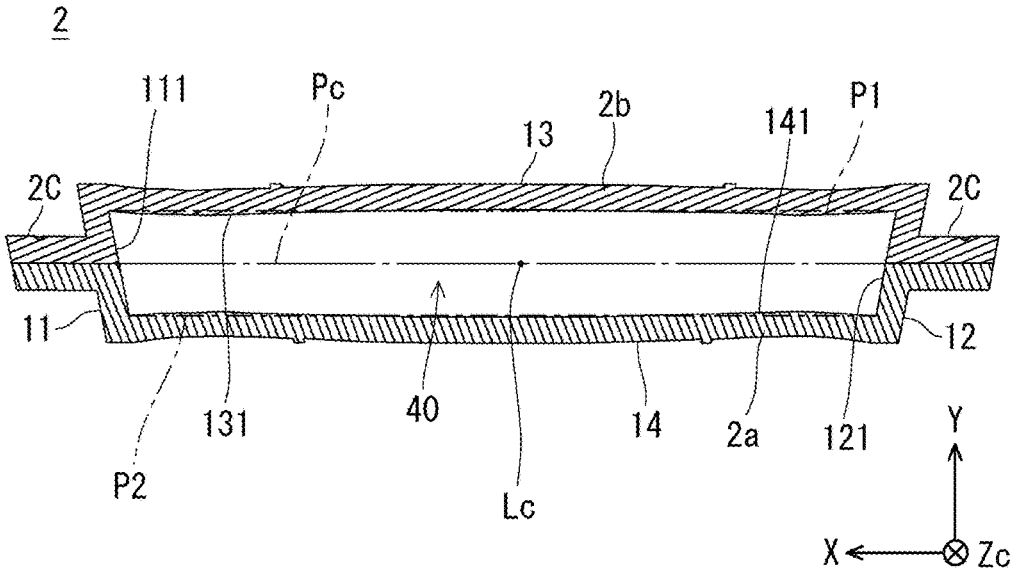
FIG. 14 is a sectional view taken along the XIV-XIV plane indicated in FIG. 10.

The shapes of the third side wall 13 and the fourth side wall 14 will be described with reference to FIGS. 10 to 14. FIG. 10 is a side view of the throat 2 as viewed from the side where the second side wall 12 is provided. FIGS. 11 to 14 are sectional views taken along, respectively, the XI-XI plane, the XII-XII plane, the XIII-XIII plane, and the XIV-XIV plane indicated in FIG. 10. FIGS. 11 to 13 are sectional views along the XY-plane, and FIG. 14 is a sectional view along a plane inclined relative to the XY-plane.

As illustrated in FIGS. 11 to 14, the first side wall 11 includes a side surface, serving as a first opposing surface 111, that opposes the second side wall 12. In a similar manner, the second side wall 12 includes a side surface, serving as a second opposing surface 121, that opposes the first side wall 11. The first opposing surface 111 and the second opposing surface 121 are in contact with the sound path 40 and oppose each other.

FIG. 11 illustrates a section along the position of the convex portion 1311 of the third opposing surface 131 and the position of the concave portion 1412 of the fourth opposing surface 141. Thus, in the sectional view illustrated in FIG. 11, the third opposing surface 131 has a convex shape curving away from the center plane Pc along the direction from the center toward each end in the X-direction. The fourth opposing surface 141 has a concave shape approaching the center plane Pc along the direction from the center toward each end in the X-direction.

The highest point on the convex portion 1311 of the third opposing surface 131 is referred to as a highest peak 1315. The highest peak 1315 on the convex portion 1311 lies in the center plane Pc. In other words, the highest peak 1315 on the convex portion 1311 reaches the reference center line Lc. The highest peak 1315 on the convex portion 1311 is in contact with the reference center line Lc.

FIG. 13 illustrates a section along the position of the concave portion 1312 of the third opposing surface 131 and the position of the convex portion 1411 of the fourth opposing surface 141. Thus, in FIG. 13, the third opposing surface 131 has a concave shape approaching the center plane Pc along the direction from the center toward each end in the X-direction. The fourth opposing surface 141 has a convex shape curving away from the center plane Pc along the direction from the center toward each end in the X-direction.

The highest point on the convex portion 1411 of the fourth opposing surface 141 is referred to as a highest peak 1415. The highest peak 1415 on the convex portion 1411 lies in the center plane Pc. The highest peak 1415 on the convex portion 1411 reaches the reference center line Lc. The highest peak 1415 on the convex portion 1411 is in contact with the reference center line Lc.

FIG. 12 is a sectional view taken along a plane between the planes of FIGS. 11 and 13. Specifically, FIG. 12 illustrates a section along the position of the concave portion 1312 of the third opposing surface 131 and the position of the concave portion 1412 of the fourth opposing surface 141. Thus, in FIG. 12, the fourth opposing surface 141 has a concave shape approaching the center plane Pc along the direction from the center toward each end in the X-direction. The third opposing surface 131 also has a concave shape approaching the center plane Pc along the direction from the center toward each end in the X-direction.

The concave shapes illustrated in FIG. 12 are shallower than the concave shapes illustrated in FIGS. 11 and 13. In FIG. 14, the third opposing surface 131 and the fourth opposing surface 141 are each formed in a wave-like shape having a concave portion and a convex portion.

In this manner, the throat 2 is provided with a structure in which the third opposing surface 131 includes the convex portion 1311 and the concave portion 1312 and the fourth opposing surface 141 includes the convex portion 1411 and the concave portion 1412. This structure makes it possible to correct the path length of the sound wave. As illustrated in FIG. 7, a sound wave passing through the center in the X-direction passes through a wave-like winding space with large amplitudes A13 and A14, and thus the correction amount of the path length is large. Meanwhile, as illustrated in FIG. 9, a sound wave that passes through the vicinity of the first side wall 11 or the second side wall 12 passes through a space with small amplitudes A13 and A14, that is, a space that is close to being flat, and thus the correction amount of the path length is small. This configuration makes it possible to correct the path length of the sound wave. When the first opposing surface 111 and the second opposing surface 121 constitute a pair of tapered surfaces, the straight-line distance from the input opening 31 to the output opening 32 varies, but the above-described structure of the throat 2 makes it possible to equalize the path lengths. For example, the path length of the sound wave traveling along the first side wall 11 or the second side wall 12 can be made equal to the path length of the sound wave traveling along the reference center line Lc.

Figure 15:
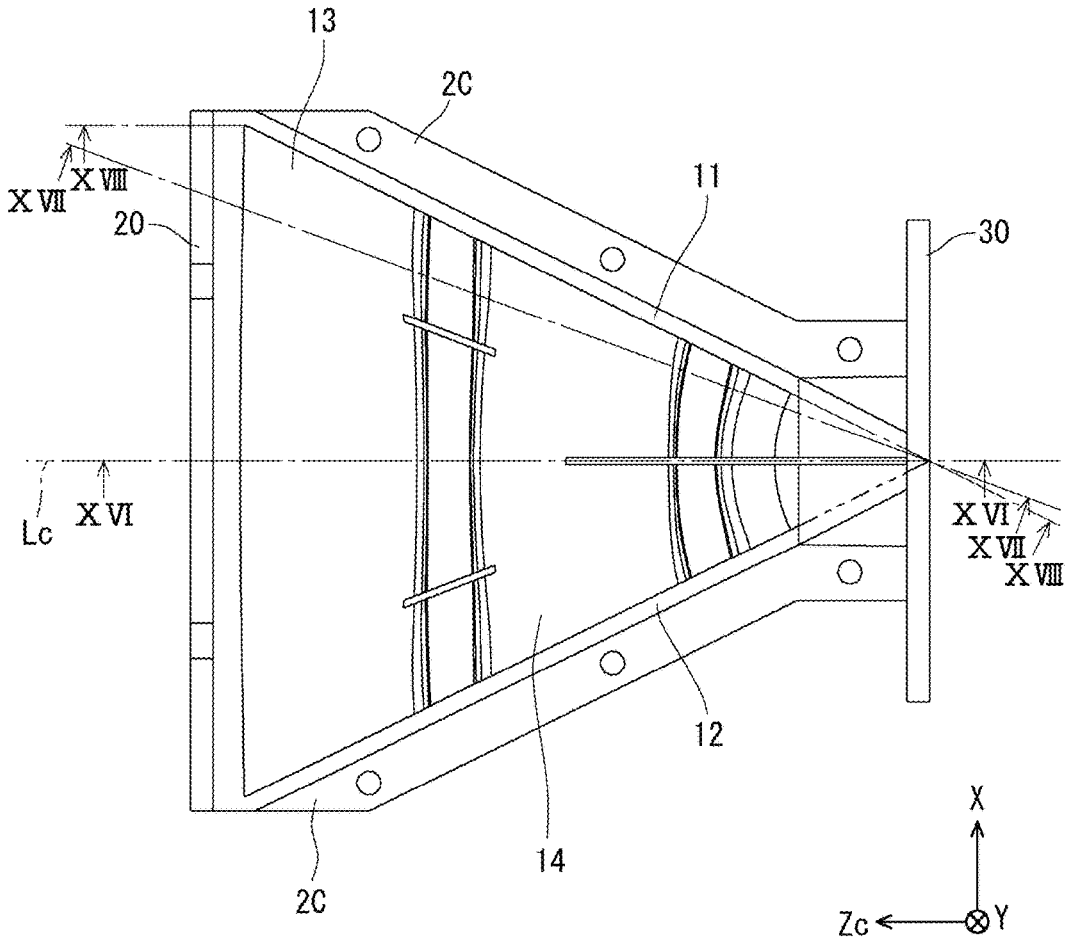
FIG. 15 is a plan view of a throat as viewed from the side where a fourth side wall 14 is provided.
Figure 16:
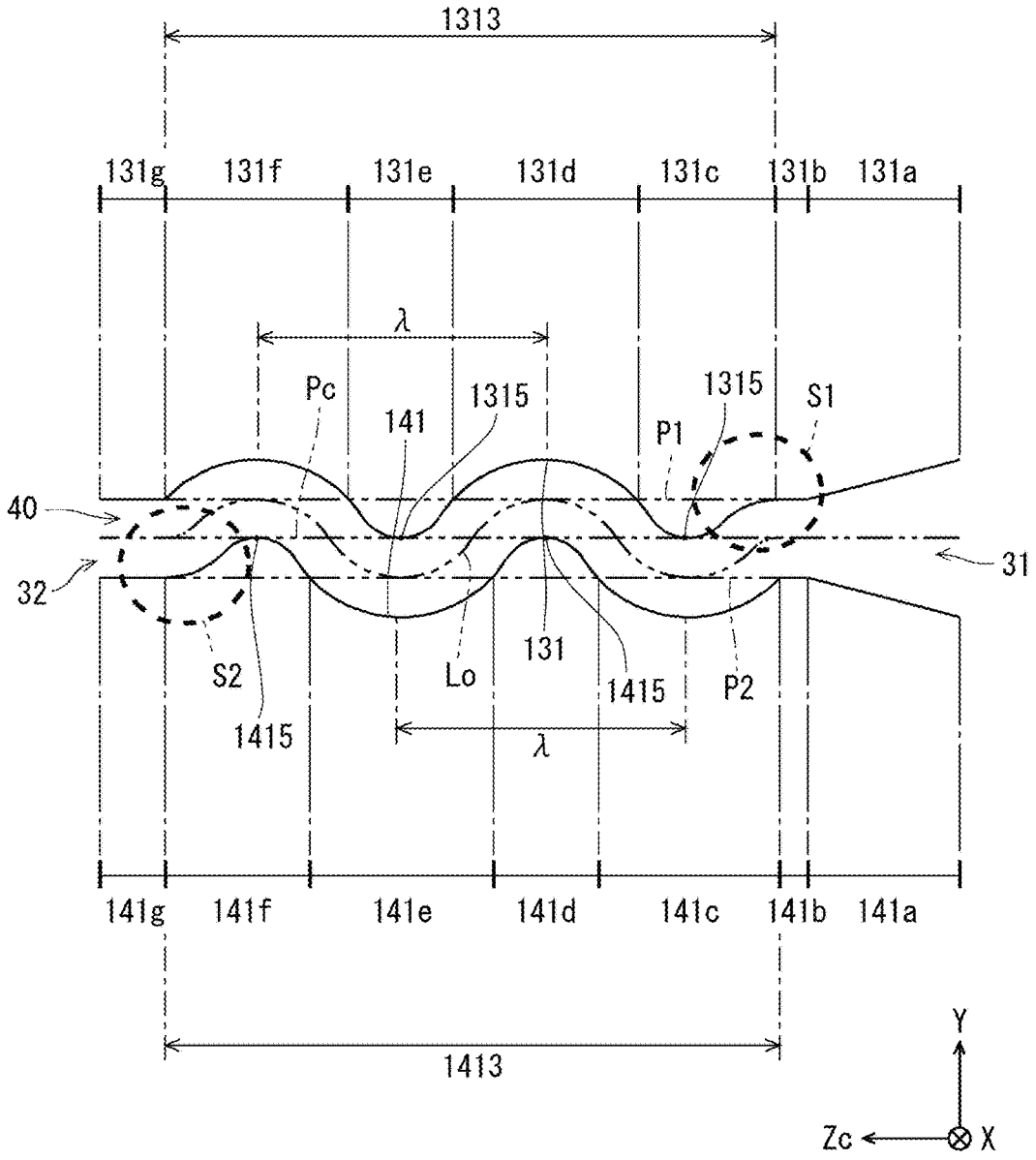
FIG. 16 is a sectional view taken along the XVI-XVI plane indicated in FIG. 15.
Figure 17:
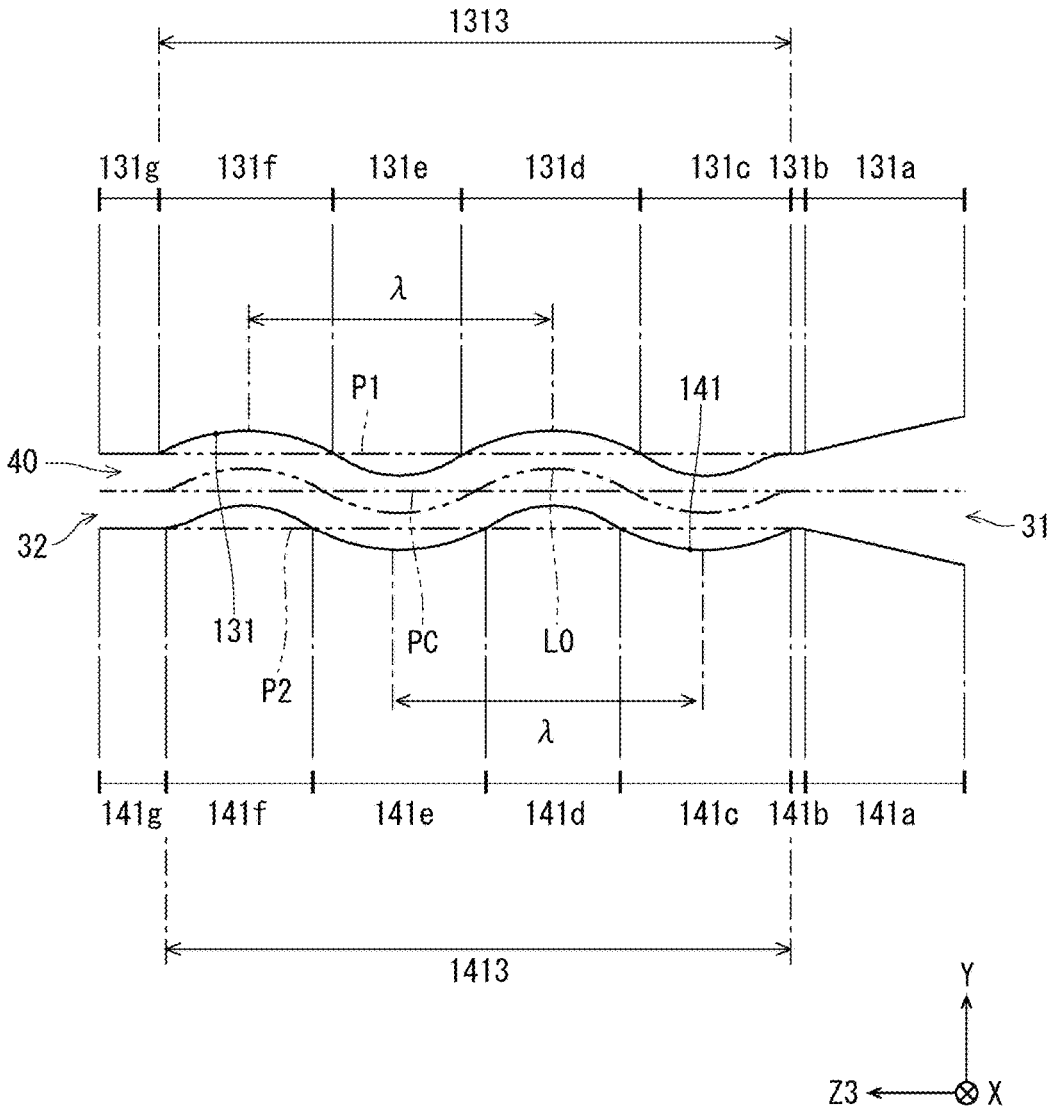
FIG. 17 is a sectional view taken along the XVII-XVII plane indicated in FIG. 15.
Figure 18:
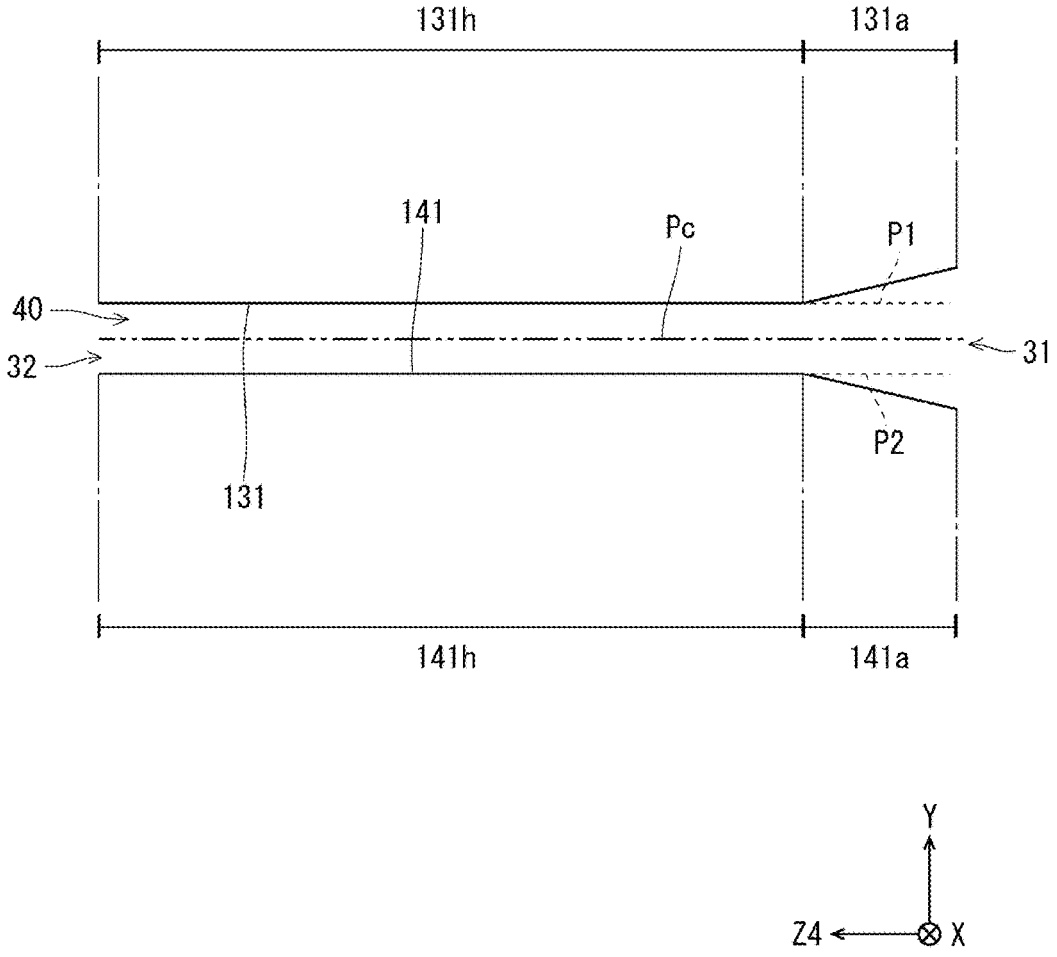
FIG. 18 is a sectional view taken along the XVIII-XVIII plane indicated in FIG. 15.

Next, specific examples of the shapes of the third opposing surface 131 and the fourth opposing surface 141 will be described with reference to FIGS. 15 to 18. FIG. 15 illustrates a configuration of the throat 2. FIGS. 16 to 18 are sectional views taken along, respectively, the XVI-XVI plane, the XVII-XVII plane, and the XVIII-XVIII plane indicated in FIG. 15.

FIG. 16 is a sectional view of the third side wall 13 and the fourth side wall 14, taken along their centers in the X-direction. In other words, FIG. 16 is a sectional view along the YZc-plane that includes the reference center line Lc. FIG. 18 is a sectional view of the throat 2 along a plane in contact with the first side wall 11. FIG. 17 is a sectional view taken along a plane between the planes of FIGS. 16 and 18. In FIGS. 17 and 18, the cutting planes are inclined relative to the Zc-direction, and thus their cutting planes are denoted as a YZ3-plane and a YZ4-plane, respectively.

As illustrated in FIGS. 16 and 17, the third opposing surface 131 includes a tapered portion 131*a*, a planar portion 131*b*, a convex portion 131*c*, a concave portion 131*d*, a convex portion 131*e*, a concave portion 131*f*, and a planar portion 131*g*. The tapered portion 131*a*, the planar portion 131*b*, the convex portion 131*c*, the concave portion 131*d*, the convex portion 131*e*, the concave portion 131*f*, and the planar portion 131*g* are disposed in this order in the direction from the input opening 31 toward the output opening 32.

The fourth opposing surface 141 includes a tapered portion 141*a*, a planar portion 141*b*, a concave portion 141*c*, a convex portion 141*d*, a concave portion 141*e*, a convex portion 141*f*, and a planar portion 141*g*. The tapered portion 141*a*, the planar portion 141*b*, the concave portion 141*c*, the convex portion 141*d*, the concave portion 141*e*, the convex portion 141*f*, and the planar portion 141*g* are disposed in this order in the direction from the input opening 31 toward the output opening 32.

As illustrated in FIG. 18, at the position in contact with the first side wall 11, the third opposing surface 131 consists of the tapered portion 131*a* and a flat portion 131*h*. In a similar manner, at the position in contact with the first side wall 11, the fourth opposing surface 141 consists of the tapered portion 141*a* and a flat portion 141*h*. At the position in contact with the first side wall 11, no corrugated shape of a periodic structure is formed. At the position in contact with the first side wall 11, the third opposing surface 131 and the fourth opposing surface 141 each have a linear shape that is parallel to the center plane Pc, and thus the amplitudes A13 and A14 are 0. At the position in contact with the second side wall 12 as well, the third opposing surface 131 and the fourth opposing surface 141 each have a linear shape, and the amplitudes A13 and A14 are 0.

The convex portion 131*c* and the convex portion 131*e* illustrated in FIGS. 16 and 17 correspond to the convex portion 1311 illustrated in FIG. 11 and so on. In a similar manner, the concave portion 131*d* and the concave portion 131*f* correspond to the concave portion 1312. The concave portion 141*c* and the concave portion 141*e* correspond to the concave portion 1412. The convex portion 141*d* and the convex portion 141*f* correspond to the convex portion 1411. The convex portion 131*c* and the concave portion 141*c* oppose each other, and the convex portion 131*e* and the concave portion 141*e* oppose each other. The convex portion 141*d* and the concave portion 131*d* oppose each other, and the convex portion 141*f* and the concave portion 131*f* oppose each other.

The tapered portion 131*a* and the tapered portion 141*a* gradually approach each other along the direction toward the output opening 32 in order to convert the circular input opening 31 to the sound path 40 having a rectangular section. The planar portion 131*b* and the planar portion 131*g* lie in the imaginary plane P1. The planar portion 141*b* and the planar portion 141*g* lie in the imaginary plane P2. The third opposing surface 131 and the fourth opposing surface 141 have periodic structures 1313 and 1413, respectively, in each of which a concave portion and a convex portion are repeated in an alternating manner.

The periodic structure 1313 of the third opposing surface 131 includes the convex portion 131*c*, the concave portion 131*d*, the convex portion 131*e*, and the concave portion 131*f*. The periodic structure 1313 of the third opposing surface 131 is disposed between the planar portion 131*b* and the planar portion 131*g*. The starting point and the end point of the periodic structure 1313 lie in the imaginary plane P1.

The periodic structure 1413 of the fourth opposing surface 141 is disposed between the planar portion 141*b* and the planar portion 141*g*. The periodic structure 1413 of the fourth opposing surface 141 includes the concave portion 141*c*, the convex portion 141*d*, the concave portion 141*e*, and the convex portion 141*f*. The starting point and the end point of the periodic structure 1413 lie in the imaginary plane P2.

For example, as illustrated in FIG. 16, the distance λ between two bottom-most portions on the third opposing surface 131 in the Zc-direction corresponds to one period in the periodic structure 1313. In a similar manner, the distance λ between two bottom-most portions on the fourth opposing surface 141 in the Zc-direction corresponds to one period in the periodic structure 1413. In a similar manner in FIG. 17, the distance λ between bottom-most portions on each of the periodic structures 1313 and 1413 corresponds to one period. The distance λ in the periodic structures 1313 and 1413 illustrated in FIG. 16 is smaller than the distance λ in the periodic structures 1313 and 1413 illustrated in FIG. 17. In addition, the periodic structure 1313 has an amplitude A13, and the periodic structure 1413 has an amplitude A14 (see FIG. 7 and so on).

An imaginary center curve L0 is set in order to define the shapes of the third opposing surface 131 and the fourth opposing surface 141. The center curve L0 is a wave-like curve connecting circular arcs such that the third opposing surface 131 and the fourth opposing surface 141 have predetermined amplitudes A13 and A14, respectively. Since two concave portions and two convex portions are provided in each of the third opposing surface 131 and the fourth opposing surface 141, the periodic structures 1313 and 1413 are each formed by connecting four circular arcs. The amplitude of the center curve L0 coincides with the amplitudes A13 and A14 in FIG. 16.

The amplitudes A13 and A14 in the respective periodic structures 1313 and 1413 along the reference center line Lc are each one half the opening width of the output opening 32 (see also FIG. 7). The opening width of the output opening 32 is the opening size of the output opening 32 in the Y-direction. The amplitude decreases along the direction from the reference center line Lc toward the first side wall 11 or the second side wall 12. Therefore, when FIGS. 16 and 17 are compared, the amplitude of the center curve L0 in FIG. 16 is greater than the amplitude of the center curve L0 in FIG. 17.

In the path from the input opening 31 to the output opening 32, the periodic structures 1313 and 1413 each include one or more periods. In other words, the sound wave is made to pass through a sound path formed by the periodic structures 1313 and 1413 each having one or more periods. This configuration makes it possible to properly correct the path length of the sound path and efficiently amplify the sound wave from the speaker without an increase in the size of the throat 2. For example, when the periodic structures 1313 and 1413 each have less than one period, the size of the throat 2 in the Y-direction need increasing in order to provide equal path lengths. As each periodic structure has one or more periods, an increase in the size can be suppressed, allowing for space-saving embedding.

As the periodic structures 1313 and 1413 each have no more than two periods, a decrease in the sound volume or the sound quality can be prevented. For example, providing too may periodic structures 1313 and 1413 causes the third opposing surface 131 and the fourth opposing surface 141 to each extend at an angle close to being perpendicular to the reference center line Lc. In this case, a sound wave reflected by the third opposing surface 131 or the fourth opposing surface 141 travels back to the input opening 31. In particular, in a high register, the third opposing surface 131 and the fourth opposing surface 141 act as barriers, and a deterioration in the sound quality thus becomes noticeable. Therefore, it is preferable that the periodic structures 1313 and 1413 each have one to two periods in a range from the input opening 31 to the output opening 32.

The highest peaks 1315 and 1415 are in contact with the center plane Pc, or the reference center line Lc. In other words, the maxima of the amplitudes A13 and A14 are each one half the opening width of the output opening 32 in the Y-direction. This configuration makes it possible to prevent a decrease in the sound quality. For example, if the highest peaks 1315 and 1415 project far beyond the center plane Pc, the directivity is produced in the sound wave emitted through the output opening 32. By keeping the highest peaks 1315 and 1415 at or not exceeding the center plane Pc, the output sound wave can be prevented from having a directivity. When the highest peaks 1315 and 1415 do not reach the center plane Pc, winding is reduced, and thus it becomes difficult to equalize the path lengths.

In the sectional views, the distance from the center curve L0 to the third opposing surface 131 is equal to the distance from the center curve L0 to the fourth opposing surface 141. The distance from the center curve L0 to the third opposing surface 131 or the fourth opposing surface 141 is the distance in the direction perpendicular to the center curve L0, and these distances coincide with the amplitudes A13 and A14. Therefore, the gap between the third opposing surface 131 and the fourth opposing surface 141 is constant in substantially the entire range from the input opening 31 to the output opening 32 except at the tapered portions 131*a* and 141*a*. This configuration makes it possible to prevent a decrease in the sound quality.

Furthermore, in the present embodiment, connection at a boundary position where the convex portion 131*c* and the planar portion 131*b* are connected to each other (S1 in FIG. 16) is smoother than connection at a boundary position where the concave portion 141*c* and the planar portion 141*b* are connected to each other. Specifically, the convex portion 131*c* is defined with a radius that is smaller than the radius of the circular arc defining the center curve L0 only at the portion of S1. At the boundary position, the convex portion 131*c* and the planar portion 131*b* are close to being parallel, and the angle formed by the convex portion 131*c* and the imaginary plane P1 is smaller than the angle formed by the concave portion 141*c* and the imaginary plane P2. A deterioration in the sound quality traceable to a sound reflected at the boundary position can be prevented.

In a similar manner, connection at a boundary position where the convex portion 141*f* and the planar portion 141*g* are connected to each other (S2 in FIG. 16) is smoother than connection at a boundary position where the concave portion 131*f* and the planar portion 131*g* are connected to each other. The convex portion 141*f* is defined with a radius that is smaller than the radius of the circular arc defining the center curve L0 only at the portion of S2. At the boundary position, the convex portion 141*f* and the planar portion 141*g* are close to being parallel, and the angle formed by the convex portion 141*f* and the imaginary plane P2 is smaller than the angle formed by the concave portion 131*f* and the imaginary plane P1. This configuration makes it possible to suppress a deterioration in the sound quality. The connection may be made smooth only in one of the connecting portions S1 and S2.

With the throat 2 having the path length correcting structure described above, the wavefront of a sound wave emitted through the output opening 32 can be made linear. Thus, a point sound source can be converted to a line sound source. Furthermore, since the angle formed by the sound path 40 and the reference center line Lc is small at the output opening 32, the emitted sound wave can be prevented from having a directivity. Since the third opposing surface 131 and the fourth opposing surface 141 are each formed to have a smooth corrugated surface, a deterioration in the sound quality or the transmission performance can be suppressed. Furthermore, since the third opposing surface 131 and the fourth opposing surface 141 are each curved like a wave having a periodic structure with one or more periods, the wavefront can be made linear in a small size in the Y-direction.

Second Embodiment

Figure 19:
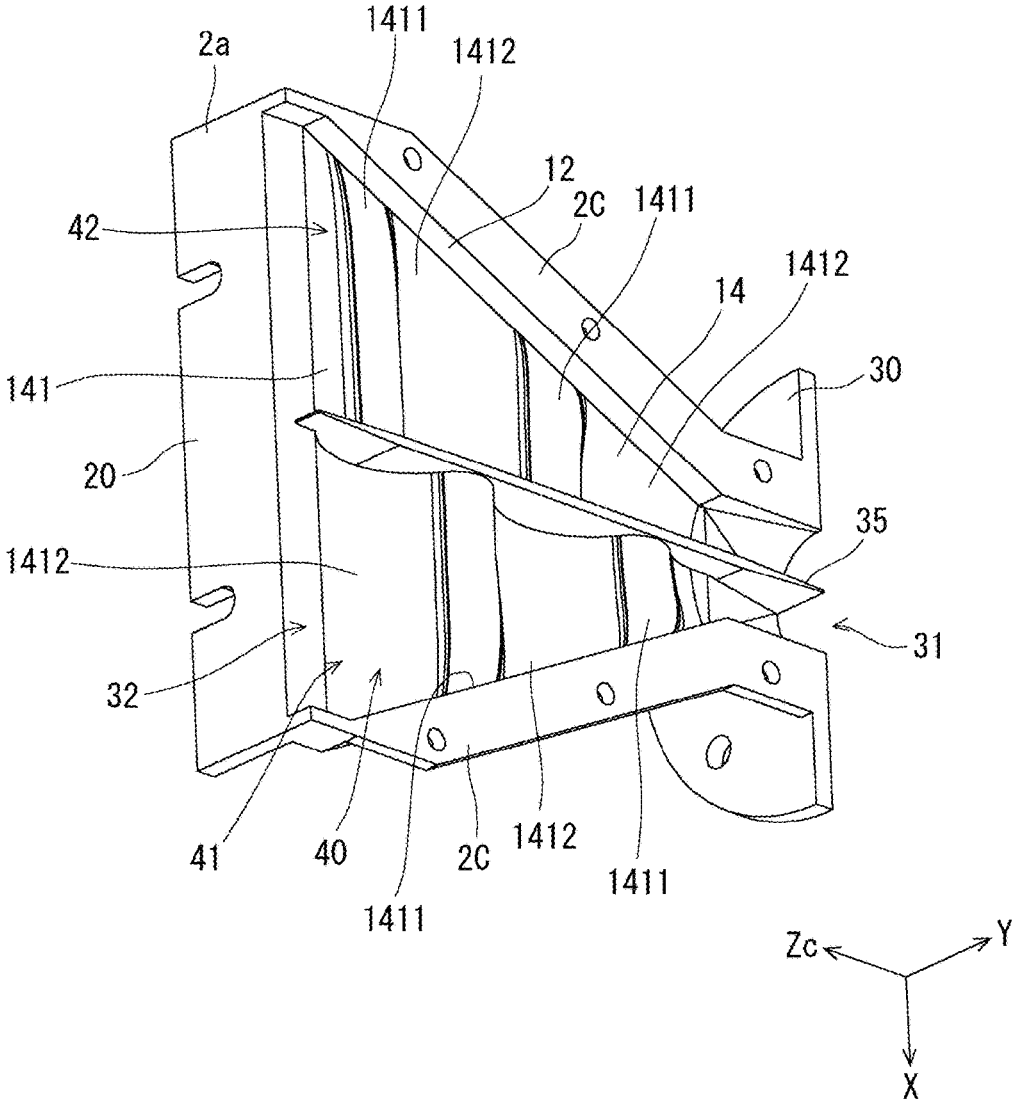
FIG. 19 is a perspective view illustrating an inner side of a second component of a throat according to the second embodiment.
Figure 20:
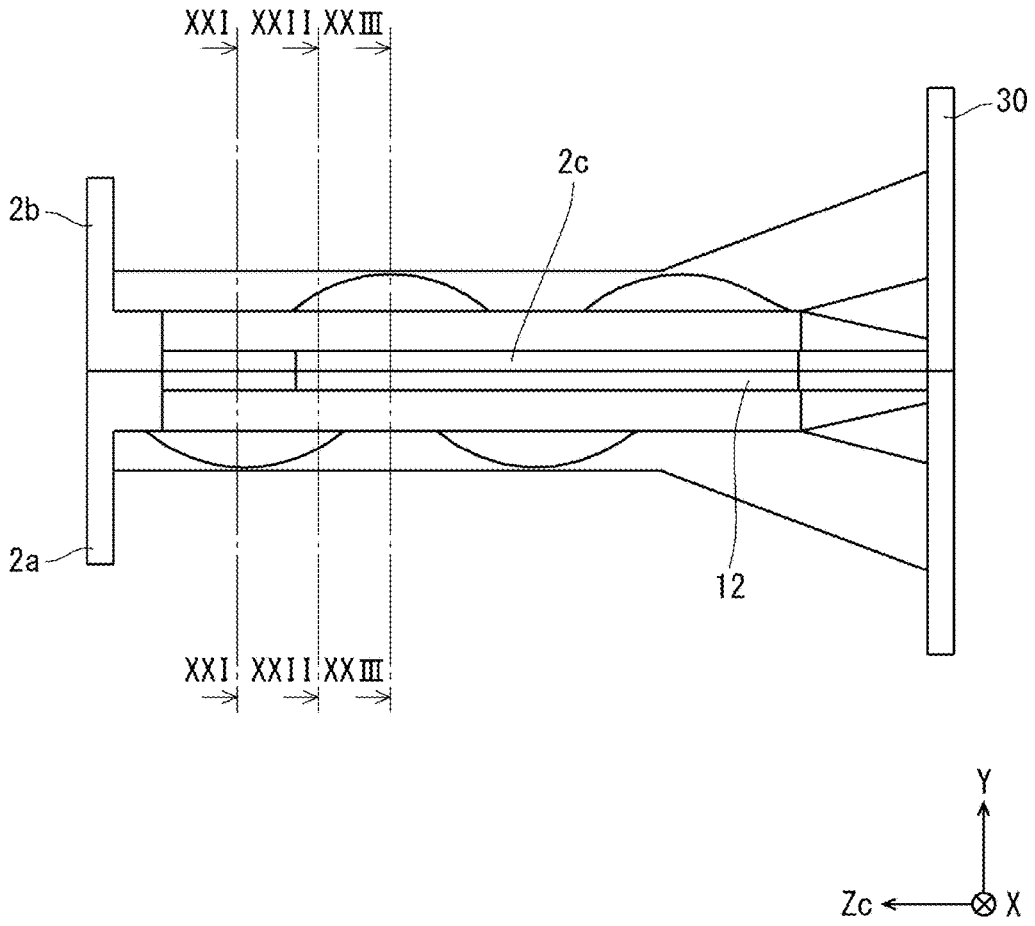
FIG. 20 is a plan view of a throat as viewed from the side where a fourth side wall 14 is provided.
Figure 21:
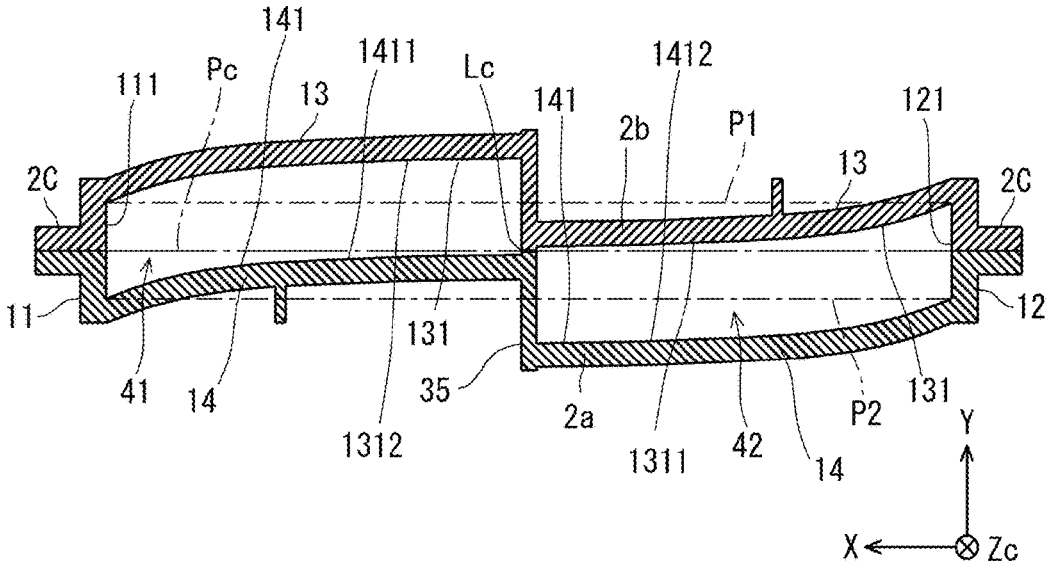
FIG. 21 is a sectional view taken along the XXI-XXI plane indicated in FIG. 20.
Figure 22:
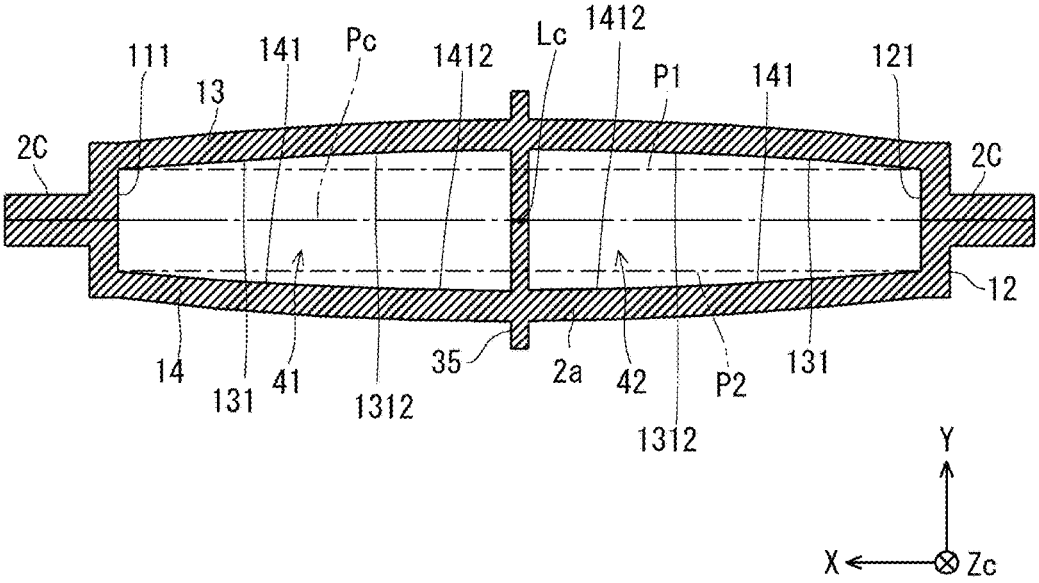
FIG. 22 is a sectional view taken along the XXII-XXII plane indicated in FIG. 20.
Figure 23:
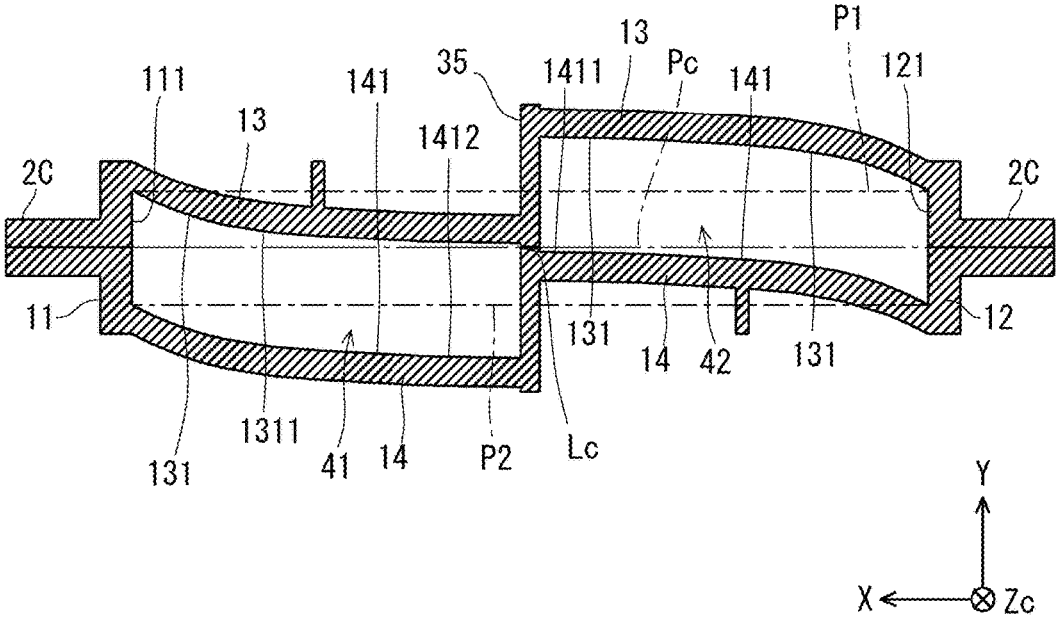
FIG. 23 is a sectional view taken along the XXIII-XXIII plane indicated in FIG. 20.

In the present embodiment, a first component 2*a* and a second component 2*b* constituting a throat 2 have the same shape. The basic structure of the throat 2, in particular, the shape for making the wavefront linear is similar to that of the first embodiment, and thus the descriptions thereof will be omitted. The throat 2 according to the present embodiment will be described with reference to FIGS. 19 to 23. FIG. 19 is a perspective view illustrating an inner side of the first component 2*a*. FIG. 20 is a plan view of the throat 2 as viewed from the side where the second side wall 12 is provided. FIGS. 21 to 23 are sectional views taken along, respectively, the XXI-XXI plane, the XXII-XXII plane, and the XXIII-XXIII plane indicated in FIG. 20.

As illustrated in FIG. 19, a dividing plate 35 is provided in the first component 2*a*. The dividing plate 35 is provided in the throat 2 in order to allow the second component 2*b* to have the same shape as the first component 2*a* as mentioned above. The dividing plate 35 divides the sound path 40 into a first space 41 and a second space 42. For example, a space from the dividing plate 35 to the first side wall 11 serves as the first space 41, and a space from the dividing plate 35 to the second side wall 12 serves as the second space 42 (see FIGS. 21 to 23).

The dividing plate 35 is so provided as to pass through the reference center line Lc and extend in the Y-direction. As illustrated in FIGS. 21 to 23, the dividing plate 35 extends from the third side wall 13 to the fourth side wall 14. A space enclosed by the dividing plate 35, the first side wall 11, the third side wall 13, and the fourth side wall 14 serves as the first space 41. A space enclosed by the dividing plate 35, the second side wall 12, the third side wall 13, and the fourth side wall 14 serves as the second space 42.

The convex portion 1411 and the concave portion 1412 of the fourth opposing surface 141 in the first space 41 and those in the second space 42 are in reversed phase. For example, the repeating order of the convex portion 1411 and the concave portion 1412 in the first space 41 is reversed in the second space 42. To be more specific, as illustrated in FIG. 19, the concave portion 1412 and the convex portion 1411 are repeated in this order from the input opening 31 in the second space 42, and the convex portion 1411 and the concave portion 1412 are repeated in this order from the input opening 31 in the first space 41. With regard to the third opposing surface 131, the convex portion 1311 and the concave portion 1312 are repeated in this order from the input opening 31 in the first space 41, and the concave portion 1312 and the convex portion 1311 are repeated in this order from the input opening 31 in the second space 42. The convex portion 1311 and the concave portion 1312 of the third opposing surface 131 in the first space 41 and those in the second space 42 are in reversed phase.

In the sectional view illustrated in FIG. 21, the third opposing surface 131 approaches the center plane Pc along the direction from the dividing plate 35 toward the first side wall 11. The third opposing surface 131 curves away from the center plane Pc along the direction from the dividing plate 35 toward the second side wall 12. The fourth opposing surface 141 curves away from the center plane Pc along the direction from the dividing plate 35 toward the first side wall 11. The fourth opposing surface 141 approaches the center plane Pc along the direction from the dividing plate 35 toward the second side wall 12. There is a step in each of the third side wall 13 and the fourth side wall 14 at the position of the dividing plate 35.

In the sectional view illustrated in FIG. 23, the third opposing surface 131 curves away from the center plane Pc along the direction from the dividing plate 35 toward the first side wall 11. The third opposing surface 131 approaches the center plane Pc along the direction from the dividing plate 35 toward the second side wall 12. The fourth opposing surface 141 approaches the center plane Pc along the direction from the dividing plate 35 toward the first side wall 11. The fourth opposing surface 141 curves away from the center plane Pc along the direction from the dividing plate 35 toward the second side wall 12. There is a step in each of the third side wall 13 and the fourth side wall 14 at the position of the dividing plate 35.

In the sectional view illustrated in FIG. 22, the third opposing surface 131 approaches the center plane Pc along the direction from the dividing plate 35 toward the first side wall 11. The third opposing surface 131 approaches the center plane Pc along the direction from the dividing plate 35 toward the second side wall 12. The fourth opposing surface 141 approaches the center plane Pc along the direction from the dividing plate 35 toward the first side wall 11. The fourth opposing surface 141 approaches the center plane Pc along the direction from the dividing plate 35 toward the second side wall 12.

This configuration makes it possible to allow the first component 2*a* and the second component 2*b* to have the same shape. The first component 2*a* and the second component 2*b* are molded with the same metal mold. Thus, the first component 2*a* and the second component 2*b* can be manufactured at a reduced cost.

When the first component 2*a* and the second component 2*b* have the same shape, as illustrated in FIGS. 21 and 23, a step is produced in each of the third side wall 13 and the fourth side wall 14 at the center in the X-direction. For example, in the section along the XY-plane, the first space 41 is defined by the concave portion 1312 and the convex portion 1411, and the second space 42 is defined by the convex portion 1311 and the concave portion 1412 (see FIG. 21). Alternatively, in the section along the XY-plane, the second space 42 is defined by the concave portion 1312 and the convex portion 1411, and the first space 41 is defined by the convex portion 1311 and the concave portion 1412. The dividing plate 35 is used to divide the sound path 40 into the first space 41 and the second space 42. This configuration makes it possible to prevent a step being produced in the sound path 40, and a decrease in the sound quality can be prevented.

Figure 24:
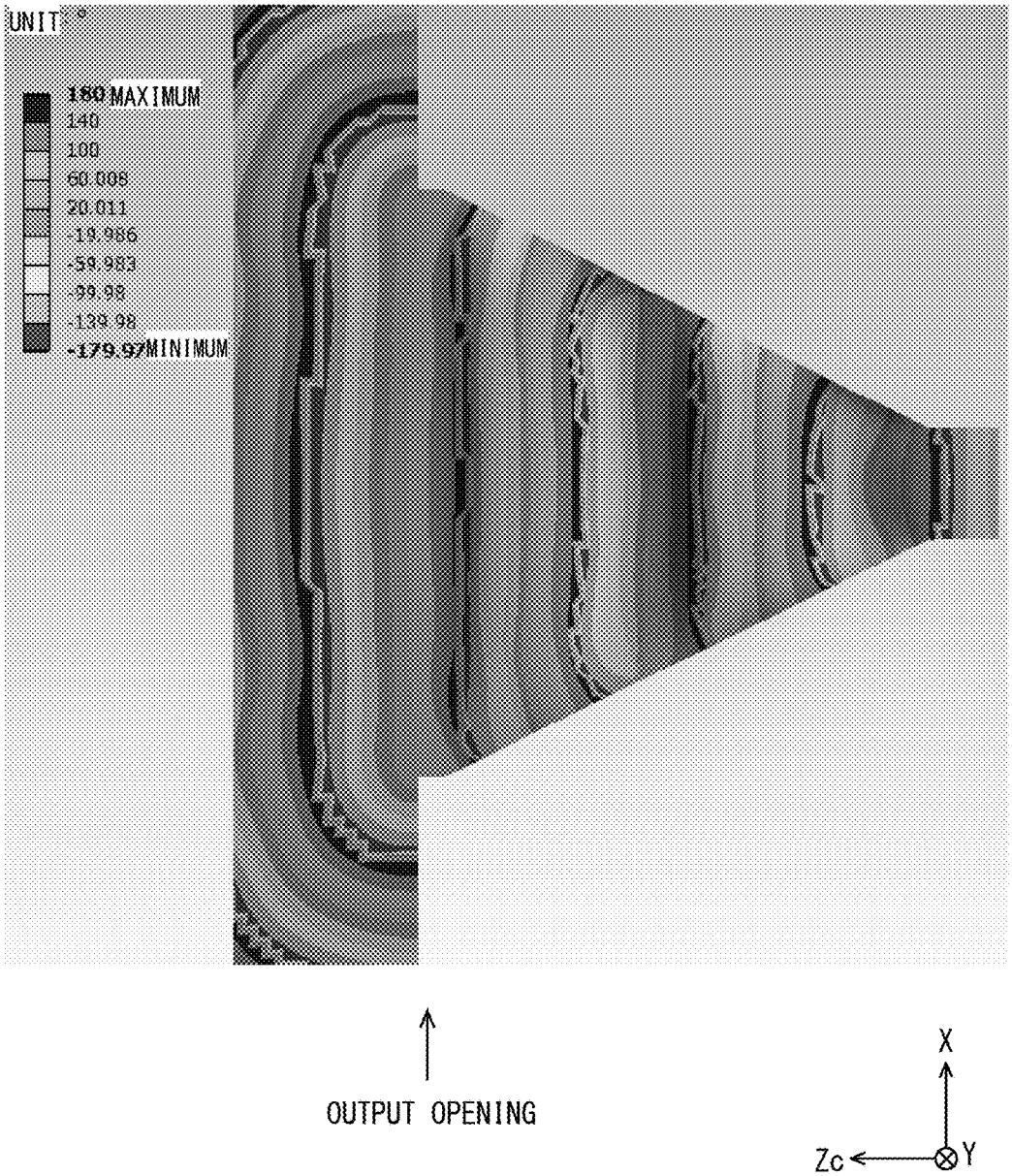
FIG. 24 is a contour diagram illustrating phases of a sound wave obtained when a throat according to an embodiment is used.
Figure 25:
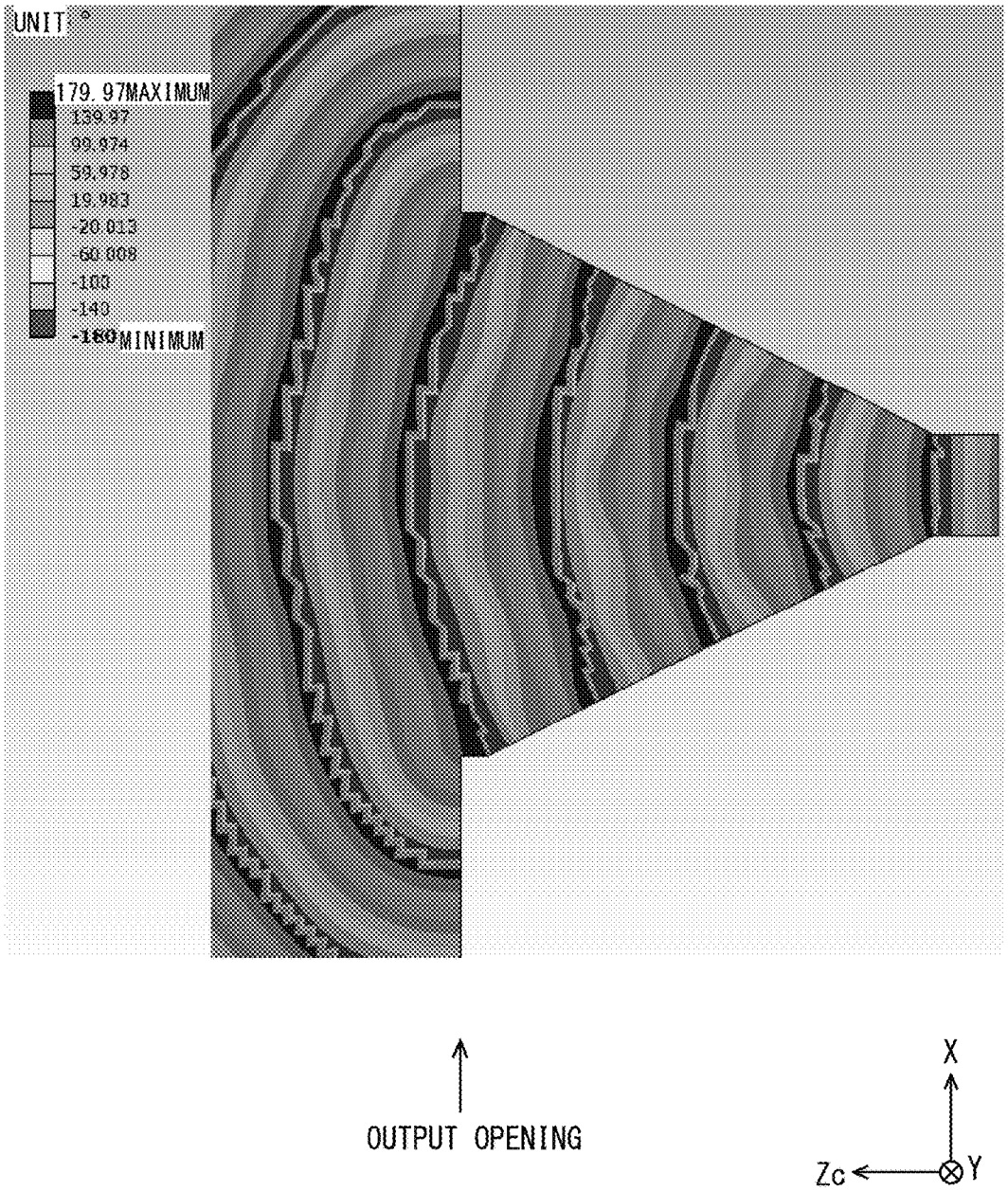
FIG. 25 is a contour diagram illustrating phases of a sound wave obtained when a throat according to a comparative example is used.

Advantageous Effects of the throat according to the present embodiment will be described with reference to FIGS. 24 to 27. FIGS. 24 and 25 each illustrate phases of a sound wave. FIG. 24 illustrates a simulation result obtained when the throat according to the present embodiment is used, and FIG. 25 illustrates a simulation result obtained in a comparative example in which a straight throat with no concavity or convexity is used. The phases can be made more flush with one another at the output opening in FIG. 24 than in FIG. 25. Thus, the wavefront of the sound wave emitted through the output opening can be made linear, and the wavefront can be made closer to that of a line sound source. The use of the throat structure according to the present embodiment makes it possible to properly correct the sound path length.

Figure 26:
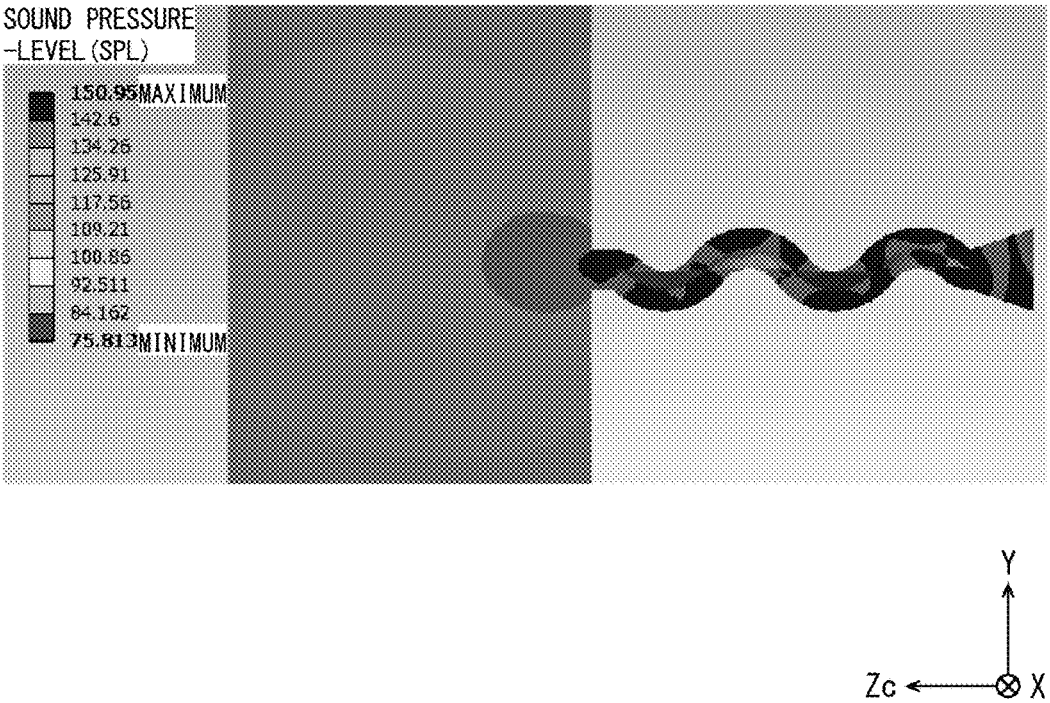
FIG. 26 is a contour diagram illustrating sound pressure levels of a sound wave obtained when a throat according to an embodiment is used.
Figure 27:
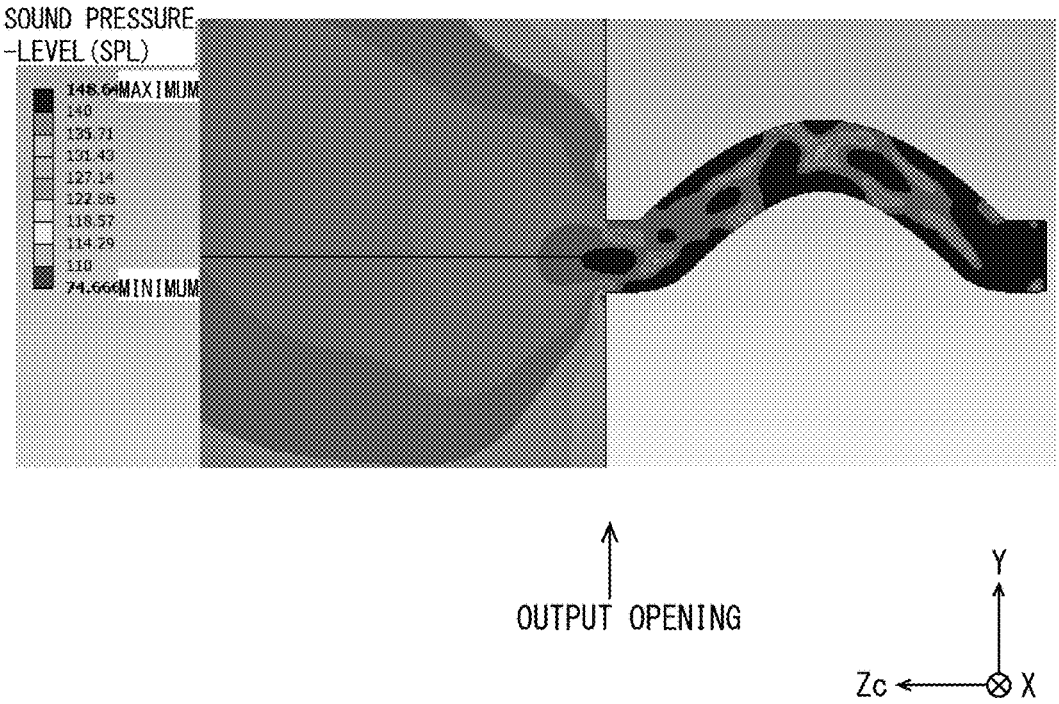
FIG. 27 is a contour diagram illustrating sound pressure levels of a sound wave obtained when a throat according to a comparative example is used.

FIGS. 26 and 27 each illustrate a sound pressure level of a sound wave along a section at the center in the X-direction. FIG. 26 illustrates a simulation result obtained when the throat according to the present embodiment is used, and FIG. 27 illustrates a simulation result obtained when the throat described in Japanese Unexamined Patent Application Publication No. 2008-278145 is used. A comparison between FIGS. 26 and 27 reveals that the sound pressure level is closer to being symmetric about the center in the Y-direction in the structure of the throat according to the present embodiment than in that of the comparative example. Therefore, the sound wave can be prevented from having a directivity.

The first and second embodiments can be combined as desirable by one of ordinary skill in the art.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that Applicant's intent is to encompass equivalents of all claim elements, even if amended later during prosecution.

What is claimed is:

1. A throat configured to correct a path length of a sound wave output by a sound source, the throat comprising:

a first side wall;

a second side wall;

a third side wall; and a fourth side wall, the first to fourth side walls defining a sound path extending from an input opening to an output opening, wherein the first side wall and the second side wall oppose each other with the sound path interposed therebetween, the third side wall and the fourth side wall oppose each other with the sound path interposed therebetween, the output opening has a lengthwise direction extending in a direction from the first side wall toward the second side wall and a widthwise direction extending in a direction from the third side wall toward the fourth side wall, the first side wall has a first opposing surface opposing the second side wall, and the second side wall has a second opposing surface opposing the first opposing surface, the first opposing surface and the second opposing surface constituting a pair of tapered surfaces with a gap therebetween increasing along a direction from the input opening toward the output opening, the third side wall has a third opposing surface opposing the fourth side wall, the third opposing surface being formed into a curved surface having a convex portion and a concave portion, and the third opposing surface having a periodic structure in which the convex portion and the concave portion are disposed in a repeated manner in the direction from the input opening toward the output opening, the fourth side wall has a fourth opposing surface opposing the third side wall, the fourth opposing surface being formed into a curved surface having a convex portion and a concave portion, the fourth opposing surface having a periodic structure in which the convex portion and the concave portion are disposed in a repeated manner in the direction from the input opening toward the output opening, the convex portion of the third opposing surface and the concave portion of the fourth opposing surface are so disposed as to oppose each other, and the concave portion of the third opposing surface and the convex portion of the fourth opposing surface are so disposed as to oppose each other, and with a straight line connecting a center of the input opening and a center of the output opening serving as a reference center line, an amplitude of the curved third opposing surface and an amplitude of the curved fourth opposing surface gradually decrease along a direction from the reference center line to the first opposing surface or the second opposing surface.

2. The throat according to claim 1, wherein a highest peak on the convex portion of the third opposing surface is in contact with the reference center line, and a highest peak on the convex portion of the fourth opposing surface is in contact with the reference center line.

3. The throat according to claim 1, wherein the periodic structure of each of the third opposing surface and the fourth opposing surface includes one or more periods along the direction from the input opening toward the output opening.

4. The throat according to claim 3, wherein a planar portion is provided in the periodic structure in at least one of its end toward the input opening and its end toward the output opening, and a connecting portion where the planar portion and the convex portion are connected to each other is smoother than a connecting portion where the planar portion and the concave portion are connected to each other.

5. The throat according to claim 1, wherein a gap between the third opposing surface and the fourth opposing surface is constant within a predetermined range in the direction from the input opening toward the output opening.

6. The throat according to claim 1, wherein a dividing plate is so provided as to pass through the reference center line and follow the widthwise direction, the dividing plate dividing the sound path into a first space and a second space.

7. A speaker system comprising:

the throat according to claim 1;

a sound source disposed at the input opening of the throat; and a horn disposed at the output opening of the throat.

* * * * *